US007614720B2

(12) United States Patent
Otsuka

(10) Patent No.: US 7,614,720 B2
(45) Date of Patent: Nov. 10, 2009

(54) ALGORITHM FOR PRELIMINARY FIRING OF INK DROPLETS THROUGH INKJET NOZZLES PRIOR TO INKJET PRINTING OPERATION

(75) Inventor: Naoki Otsuka, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 460 days.

(21) Appl. No.: 11/723,598

(22) Filed: Mar. 21, 2007

(65) Prior Publication Data

US 2007/0229583 A1 Oct. 4, 2007

(30) Foreign Application Priority Data

Mar. 30, 2006 (JP) ..... 2006-093915
Mar. 12, 2007 (JP) ..... 2007-061497

(51) Int. Cl.
*B41J 2/165* (2006.01)

(52) U.S. Cl. ..... 347/23; 347/35

(58) Field of Classification Search ..... 347/23, 347/24, 29, 30, 32, 33, 35, 14, 19
See application file for complete search history.

(56) References Cited

U.S. PATENT DOCUMENTS

2007/0132802 A1* 6/2007 Ouchi

FOREIGN PATENT DOCUMENTS

| | | |
|---|---|---|
| JP | 5-388134 | 12/1993 |
| JP | 9-267469 | 10/1997 |
| JP | 2002-240265 | 8/2002 |

* cited by examiner

*Primary Examiner*—Shih-Wen Hsieh
(74) *Attorney, Agent, or Firm*—McDermott Will & Emery LLP

(57) ABSTRACT

An algorithm for preliminary firing of ink droplets through inkjet nozzles prior to inkjet printing operation is disclosed. According to this algorithm, a calculation is made of a scheduled time of a next nozzle-cleaning operation which succeeds a time instant at which a last firing operation was implemented, by a predetermined reference-time-interval, and an operation is performed concerning a reduction in a frequency at which the nozzle-cleaning operation is repeated, by monitoring the calculated scheduled-time of nozzle-cleaning operation, on a time-line basis.

17 Claims, 11 Drawing Sheets

ALGORITHM FOR PRELIMINARY FIRING OF INK DROPLETS THROUGH INKJET NOZZLES PRIOR TO INKJET PRINTING OPERATION

CROSS-REFERENCE TO RELATED APPLICATIONS

This application is based on Japanese Patent Applications No. 2006-93915 filed Mar. 30, 2006 and No. 2007-61497 filed Mar. 12, 2007, the contents of which are incorporated hereinto by reference.

BACKGROUND OF THE INVENTION

1. Field of the Invention

The invention relates to techniques of preliminary firing of ink droplets through inkjet nozzles prior to ink ejection for an image recording cycle.

2. Description of the Related Art

There are known as recoding devices for forming desired image(s) on a recording medium, such as a sheet of paper, inkjet recording devices configured to form desired image(s) on the recording medium using a printhead having thereon an array of plurality of inkjet nozzles and orifices in which the inkjet nozzles terminate. The inkjet recording devices are of, for example, piezoelectric-type, thermal-type (or bubble-jet-type), or the like.

During the use of such inkjet recording devices, air bubbles, dust or dirt could be introduced into ink collected within inkjet nozzles terminating in inkjet orifices, and the collection of ink could rise in viscosity due to evaporation of the ink solvent.

For those reasons, it is conventional to perform preliminary firing or expelling of ink droplets through the inkjet nozzles prior to firing of ink droplets for an image recording cycle, for removal of performance-degrading factors, such as air bubbles, dust or dirt, from the inkjet nozzles. This preliminary firing, in general, is repeated during a succession of operation of inkjet recording devices.

An example of a conventional version of such inkjet recording devices is disclosed in Japanese Patent Application Publication No. HEI 5-338134.

In this example, a gross quantity of ink droplets ejected or equivalently the total number of ink droplets ejected (hereinafter, referred to as "expelled-drop count") is measured on a per-inkjet-nozzle basis. Further, time intervals at which successive cycles of preliminary firing of ink droplets are controlled as a function of the measured gross-quantity of ink droplets ejected or expelled-drop count, eventually resulting in a controlled total-number or frequency of cycles of preliminary firing performed.

More specifically, in this example, when a scheduled timing of preliminary firing of ink droplets is reached, and when, at the same time, the smallest one of the expelled-drop counts which have been measured for the inkjet nozzles, respectively, is large enough to make it unnecessary to perform preliminary firing of ink droplets as scheduled, the time intervals between cycles of preliminary firing are prolonged, without performing preliminary firing as scheduled, despite that the scheduled timing of preliminary firing has been reached.

It would be desirable to reduce an amount of ink to be spent by preliminary firing only for cleaning the inkjet nozzles.

BRIEF SUMMARY OF THE INVENTION

In general, the invention relates to techniques of preliminary firing of ink droplets through inkjet nozzles prior to firing of ink droplets for recording or printing an image.

According to some aspects of the invention, a calculation is made of a scheduled time of a next nozzle-cleaning operation which succeeds a time instant at which a last firing operation was implemented, by a predetermined reference-time-interval.

Further, an operation is performed concerning a reduction in a frequency at which the nozzle-cleaning operation is repeated, by monitoring the calculated scheduled-time of nozzle-cleaning operation, on a time-line basis.

The operation to be performed may be defined as an operation conducive to a reduction in the frequency of the nozzle-cleaning operations, that is to say, the frequency of preliminary firing of ink droplets, either with or without user intervention in an attempt to reduce the frequency.

It is noted here that, as used in this specification, the singular form "a," "an," and "the" include plural reference unless the context clearly dictates otherwise. It is also noted that the terms "comprising," "including," and "having" can be used interchangeably.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

General Overview

Figure 1:
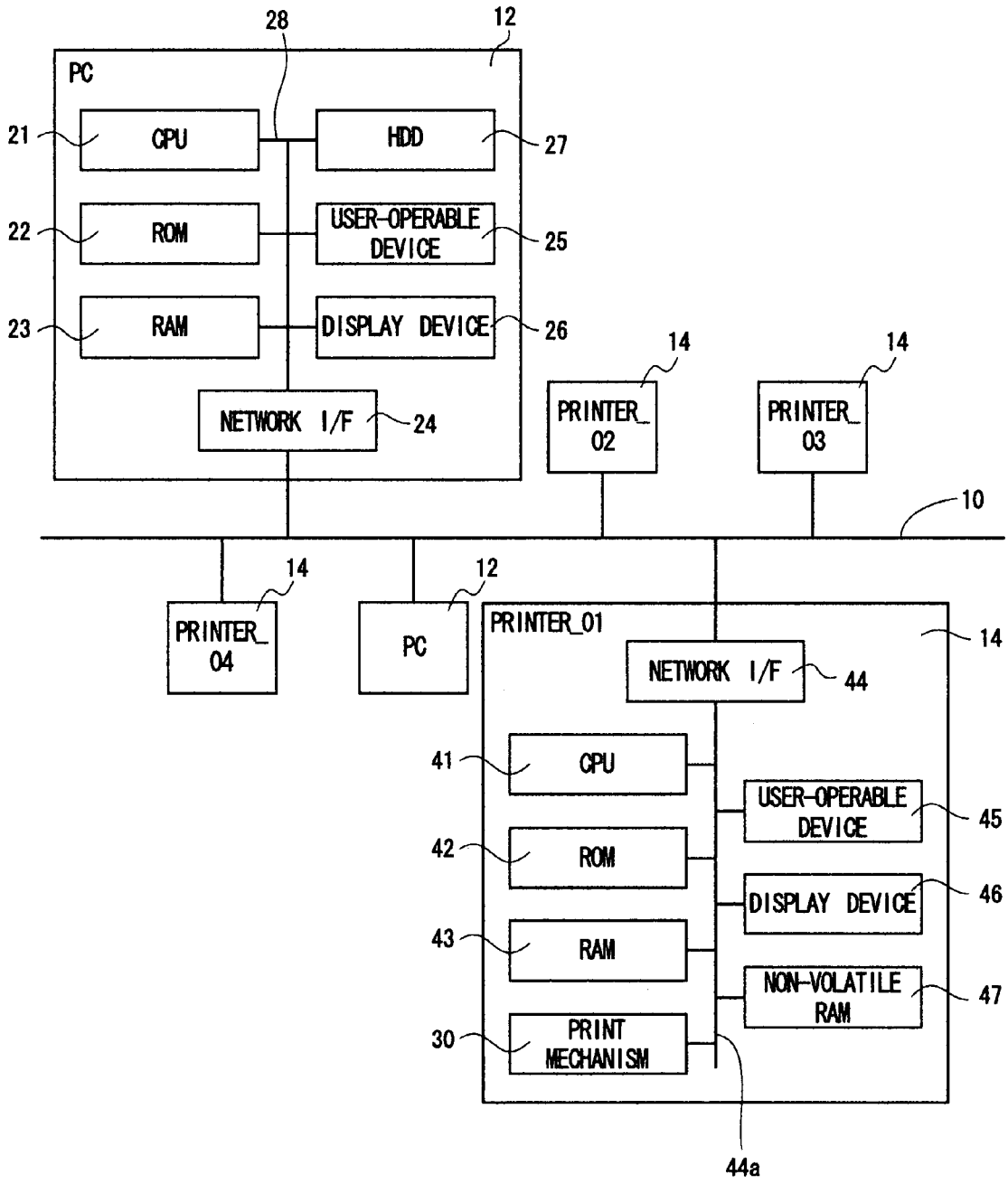
FIG. 1 is a schematic diagram illustrating the hardware configuration of a printing system constructed according to a first illustrative embodiment of the present invention.

According to a first aspect of the invention, there is provided an inkjet recording device in which a plurality of inkjet nozzles are activated to fire ink droplets, thereby performing a nozzle cleaning operation (i.e., preliminary firing of ink droplets), a scheduled time of a next nozzle-cleaning operation is calculated which succeeds a time instant at which a last firing operation was implemented, by a predetermined reference-time-interval, and an operation is performed concerning a reduction in a frequency at which the nozzle-cleaning operation is repeated, by monitoring the calculated scheduled-time of nozzle-cleaning operation, on a time-line basis.

According to a second aspect of the invention, there is provided an inkjet recording device arranged to prompt a user to enter a print command into the inkjet recording device to selectively activate a plurality of inkjet nozzles for the formation of desired image(s) on a recording medium, prior to a scheduled-time of nozzle-cleaning operation.

According to a third aspect of the invention, there is provided an inkjet recording device arranged to automatically print a predetermined picture on a recording medium based on a predetermined print data, if a scheduled-time of nozzle-cleaning operation is reached.

According to a fourth aspect of the invention, there is provided a network-attached recording system in which a plurality of recording devices including at least one inkjet recording device are attached to a network (e.g., a LAN, a WAN, the Internet, an intranet), and which allows a user to selectively use the plurality of recording devices.

In this network-attached recording system, a scheduled time of monitoring the at least one inkjet recording device is calculated for the at least one inkjet recording device, as a time instant preceding a scheduled-time of nozzle-cleaning operation by a predetermined time period, and an operation is performed concerning selection of one of the at least one inkjet recording device which is scheduled to be monitored at a current time.

According to a fifth aspect of the invention, there is provided a method of controlling an inkjet recording device, which includes calculating a scheduled time of nozzle-cleaning operation which succeeds a time instant at which a last firing operation was implemented, by a predetermined reference-time-interval; and performing an operation concerning a reduction in a frequency at which a nozzle-cleaning operation is repeated, by monitoring the calculated scheduled-time of nozzle-cleaning operation, on a time-line basis.

ILLUSTRATIVE EMBODIMENTS

According to the invention, the following modes are provided as illustrative embodiments of the invention.

According to a first mode of the invention, there is provided an inkjet recording device comprising:

a printhead having a plurality of inkjet nozzles for firing ink droplets therethrough;

a printing controller arranged to operate, upon reception of a print command, to selectively activate the plurality of inkjet nozzles to fire ink droplets, thereby performing a printing operation for printing an image on a recording medium;

a nozzle-cleaning controller arranged to activate the plurality of inkjet nozzles to fire ink droplets, thereby performing a nozzle cleaning operation for removing performance-degrading factors from the plurality of inkjet nozzles;

a calculator arranged to calculate a scheduled time of a next nozzle-cleaning operation which succeeds a time instant at which a last firing operation was implemented by the printhead, by a predetermined reference-time-interval;

a nozzle-cleaning activator arranged to activate the nozzle-cleaning controller if a current time reaches the calculated scheduled-time of nozzle-cleaning operation; and a frequency reducer arranged to perform an operation concerning a reduction in a frequency at which the nozzle-cleaning operation is repeated by the printhead, by monitoring the calculated scheduled-time of nozzle-cleaning operation, on a time-line basis.

As described above, there has been proposed for inkjet recording devices a technique of prolonging the time intervals of preliminary firing of ink droplets, as a function of the expelled-drop count.

No conventional inkjet recording device, however, is configured to notify a user of the time that next preliminary firing is scheduled to occur.

In addition, the preliminary firing, once performed, consumes an amount of costly ink only for nozzle cleaning. On the other hand, normal firing of ink droplets (for image recording) is common to the preliminary firing in that each firing, when performed, causes ink droplets to be expelled from the inkjet nozzles, with the capability of the normal firing to achieve at least in part a nozzle cleaning function to be achieved by the preliminary firing.

Replacement of the preliminary firing with the normal firing, therefore, would provide an increased tendency of the time intervals of preliminary firing actually performed to prolong, to thereby provide an increased tendency of an amount of ink to be wasted to reduce.

The above-mentioned conventional inkjet recording devices, however, because of their configuration not allowing a user to be aware of the time that next preliminary firing is scheduled to occur, are incapable of soliciting the user to timely issue to the inkjet recording devices a command to perform the normal firing, which can eliminate the initiation of preliminary firing and reduce the frequency of preliminary firing.

For those reasons, the above-mentioned conventional inkjet recording devices fail to adequately satisfy a user demand to minimize the amount of wasted ink.

In other words, during the use of the above-mentioned conventional inkjet recording devices, next preliminary firing could be eliminated accidentally if the gross quantity of ink droplets ejected happens to become adequate, such as if an increased number of printing cycles happen to occur, before a scheduled time of the next preliminary firing, while the next preliminary firing cannot be eliminated with a user intent, because of the incapability of intentionally causing those inkjet recording devices to print desired image(s) on a recording medium in a timely manner, to concurrently accomplish the goal of eliminating the next preliminary firing.

In contrast, the inkjet recording device constructed according to the first mode of the invention is configured to include a frequency reducer which monitors the scheduled time of nozzle-cleaning operation on a time-line basis, to thereby at least contributably reduce the frequency at which the nozzle cleaning operations are actually performed by the printhead, relative to that provided when the frequency reducer is absent. This results in a reduced amount of ink to be spent only for nozzle cleaning.

In this regard, the "frequency reducer" may be configured to perform, for example, an operation that is conducive to a reduction in the frequency at which the nozzle cleaning operations are to be actually performed.

Such an operation may be defined as, for example, an operation to cause the printhead to fire ink droplets for the printing purpose, subject to at least partial user-intervention, or without user intervention, that is to say, automatically.

According to a second mode of the invention, the frequency reducer included in the inkjet recording device according to the first mode of the invention is configured to include a prompter arranged to prompt a user to enter the print command into the printing controller, prior to the calculated scheduled-time of nozzle-cleaning operation.

In this inkjet recording device, the printhead is caused to perform ink firing for the printing purpose (i.e., normal ink-firing), subject to at least partial user-intervention, before the scheduled time of nozzle-cleaning operation is reached.

In this inkjet recording device, as a result, the normal ink-firing performed prior to the scheduled time of nozzle-cleaning operation reduces the probability that the ink firing will be performed for nozzle cleaning at the scheduled time of nozzle-cleaning operation.

The reduced probability that the ink firing will be performed for nozzle cleaning at the scheduled time of nozzle-cleaning operation results in an increased probability that next ink firing will be actually performed for nozzle cleaning after an extended length of time elapsed, and therefore, an increased probability that the nozzle cleaning operations will be actually performed with reduced frequency.

According to a third mode of the invention, the frequency reducer included in the inkjet recording device according to the first or second mode of the invention is configured to include a presentation device arranged to present to a user, time information pertaining to the calculated scheduled-time of nozzle-cleaning operation.

According to a fourth mode of the invention, the frequency reducer included in the inkjet recording device according to any one of the first through third modes of the invention is configured to include:

a calculating section arranged to calculate a scheduled time of notification which precedes the calculated scheduled-time of nozzle-cleaning operation by a predetermined time period; and a notifier arranged to provide a user with a notification indicating that the printhead is scheduled to initiate the next nozzle-cleaning operation soon, through activation of a visible, audible or tactual alarm, if a current time reaches the calculated scheduled-time of notification.

In this inkjet recording device, an alarm is activated at the scheduled time of notification preceding the scheduled time of nozzle-cleaning operation, to thereby notify a user that the next nozzle-cleaning operation is scheduled to be initiated soon by the printhead.

As a result, a user, who wishes to use a certain amount of ink for the combined purposes of printing an image and cleaning the inkjet nozzles, rather than use a certain amount of ink only for cleaning the inkjet nozzles, becomes capable of timely entering a print command into the inkjet recording device, so that the probability of occurrence of the next nozzle-cleaning operation can be reduced.

In other words, this inkjet recording device, if the scheduled time of notification preceding the scheduled time of nozzle-cleaning operation is reached, provides a notification to a user, which enables the user to be aware that the next nozzle-cleaning operation is scheduled to be occur in a short while.

If, at this moment, there is print data to be used for printing in a short while, a user is capable of causing the inkjet recording device to perform a printing operation based on the print data, before the scheduled time of nozzle-cleaning operation is reached.

The occurrence of a printing operation prior to the scheduled time of nozzle-cleaning operation increases the probability that the next nozzle-cleaning operation will actually occur at a delayed time, resulting in reduced probability that a certain amount of ink will be wasted only for cleaning the inkjet nozzles.

According to a fifth mode of the invention, the calculator included in the inkjet recording device according to any one of the first through fourth modes of the invention is configured to include:

a storage in which data indicative of the time instant of the last firing operation is to be stored; and a calculating section arranged to calculate the scheduled time of the next nozzle-cleaning operation, by adding the predetermined reference-time-interval to the time instant of the last firing operation indicated by the data which has been stored in the storage.

According to a sixth mode of the invention, the notifier included in the inkjet recording device according to the fourth mode of the invention is configured to include:

a calculating section arranged to calculate the scheduled time of notification, by subtracting the predetermined time period from the calculated scheduled-time of nozzle-cleaning operation;

a comparator arranged to compare the calculated scheduled-time of notification and a current time with each other; and an alarm activator arranged to activate the alarm if a status of the comparator indicates that the current time has reached the scheduled time of notification.

In this regard, the "alarm" may be configured to continue operating from the scheduled time of notification preceding the scheduled time of nozzle-cleaning operation, up to a time that a user issues a print command to the inkjet recording device (a time that next preliminary firing occurs, at the latest), and alternatively, may be configured to be activated only once or more times intermittently, immediately after the scheduled time of notification is reached.

According to a seventh mode of the invention, the inkjet recording device according to the fourth or sixth mode of the invention is configured to further include:

a pre-setter arranged to pre-set an inhibition time range for notification during which the notifier is to be inhibited from notifying the user; and a notification inhibitor arranged to inhibit the notifier from notifying the user, when the calculated scheduled-time of notification is within the pre-set inhibition time range for notification.

In this inkjet recording device, when the calculated scheduled-time of notification preceding the scheduled time of nozzle-cleaning operation is within the inhibition time range for notification, the notifier is inhibited from providing a notification to a user.

In this regard, the "inhibition time range for notification" may be defined as, for example, a time range during which the inkjet recording device is not accessible to a user. This inkjet recording device, therefore, would be advantageous in avoiding useless notification to the user, for example.

According to an eighth mode of the invention, the inkjet recording device according to any one of the fourth, sixth and seventh modes of the invention is configured to further include:

a pre-setter arranged to pre-set an inhibition time range for notification during which the notifier is to be inhibited from notifying the user; and a changer arranged to operate when the calculated scheduled-time of notification is within the pre-set inhibition time range for notification, to change the calculated scheduled-time of notification to a time instant preceding a start time of the pre-set inhibition time range for notification.

In this inkjet recording device, when the calculated scheduled-time of notification preceding the scheduled time of nozzle-cleaning operation is within an inhibition time range for notification, notification (e.g., warning or cautionary message or indication), that is to say, advance notice of the next nozzle-cleaning operation is provided to a user at a time instant preceding a start time of the inhibition time range for notification.

This inkjet recording device, therefore, would allow notification (e.g., warning or cautionary message or indication), that is to say, advance notice of the next nozzle-cleaning operation to be provided to a user with greater certainty.

In this regard, the "inhibition time range for notification" may be defined as, for example, a time range during which a user cannot notice any notification even if provided, such as a late-night time range, or a time range during which a user is out even when it is not late at night, such as a time period of user's absence.

The thus-defined "inhibition time range for motification" would prevent the scheduled time of nozzle-cleaning operation from being reached before a user takes necessary steps, due to the user's incapability of noticing any notification despite this inkjet recording device's attempt to provide a notification to the user.

According to a ninth mode of the invention, the inkjet recording device according to any one of the first through eighth modes of the invention is configured to further include a manual selector arranged to operate responsive to a user-issued select command to select one of the printing operation and the nozzle cleaning operation as an operation to be performed by the printhead at the calculated scheduled-time of nozzle-cleaning operation.

According to a tenth mode of the invention, the frequency reducer included in any one of the first through ninth modes of the invention is configured to include a nozzle-cleaning inhibitor arranged to inhibit the nozzle cleaning operation from being performed at the calculated scheduled-time of nozzle-cleaning operation, provided that a predetermined condition is met which relates to quantities of ink droplets ejected from the respective inkjet nozzles before the calculated scheduled-time of nozzle-cleaning operation is reached.

In an illustrative embodiment, the inkjet recording device according to any one of the first through ninth modes of the invention may be practiced such that, whenever a printing operation was performed by the scheduled time of nozzle-cleaning operation, the scheduled nozzle-cleaning operation will be eliminated.

In contrast, in the inkjet recording device according to the present mode of the invention, the scheduled nozzle-cleaning operation will be eliminated, provided that one or more printing-operations were performed by the scheduled time of nozzle-cleaning operation, so as to bring about a nozzle-cleaning effect equal in level to or adequately similar with the nozzle-cleaning effect expected to be brought about by the scheduled nozzle-cleaning operation.

This inkjet recording device, therefore, would prevent a printed image from being degraded in quality due to excessive bias toward saving of the amount of ink to be spent.

According to an eleventh mode of the invention, the frequency reducer included in the inkjet recording device according to any one of the first through tenth modes of the invention is configured to include a special-print-command issuer arranged to issue, at the calculated scheduled-time of nozzle-cleaning operation, a special print command to the printing controller for printing at least one predetermined picture on the recording medium based on a predetermined print data.

In this inkjet recording device, ink firing is performed for printing a predetermined picture, at the scheduled time of nozzle-cleaning operation, resulting in reduced probability that a nozzle-cleaning operation is performed at the scheduled time of nozzle-cleaning operation.

In an example of this inkjet recording device, information which is of concern to anyone on a daily basis, such as a weather forecast or a news articles list is printed as the "predetermined picture" at the scheduled time of the next nozzle-cleaning operation.

In this example, once the timing for the next nozzle-cleaning operation is reached, a pre-specified weather forecast or news articles list is printed, to thereby allow a certain amount of ink droplets to be fired through the inkjet nozzles for the combined purposes of printing information and cleaning the inkjet nozzles. This prevents a certain amount of ink from being wasted only for nozzle cleaning.

In this regard, the "weather forecast or news articles list" may be acquired by downloading, when needed, from an associated web-site over the Internet. This approach would allow these weather forecast and news articles list to be acquired in updated content and to be printed.

According to a twelfth mode of the invention, the inkjet recording device according to the eleventh mode of the invention is configured such that the at least one predetermined picture includes a plurality of pictures having contents not identical to each other with respect to positions of selectively-activated ones of the plurality of inkjet nozzles for printing the respective corresponding pictures, and such that the special-print-command issuer includes a sequential issuer arranged to be activated at the calculated scheduled-time of nozzle-cleaning operation and sequentially issue a plurality of special print commands to the printing controller, for sequentially printing the plurality of pictures, before a predetermined condition is met which relates to quantities of ink droplets actually ejected from the respective inkjet nozzles.

In this inkjet recording device, ink droplets are fired for a plurality of predetermined pictures on a plurality of recording media in succession, at the scheduled time of nozzle-cleaning operation, to thereby make it easier for a plurality of printing-operations that were performed at the scheduled time of nozzle-cleaning operation, to bring about a nozzle-cleaning effect equal in level to or adequately similar with the nozzle-cleaning effect expected to be brought about by the scheduled nozzle-cleaning operation.

According to a thirteenth mode of the invention, the frequency reducer included in the inkjet recording device according to the twelfth mode of the invention is configured to further include a shifter arranged to activate the nozzle cleaning controller instead of the printing controller, if the condition has failed to be met despite that the special print commands have been provided to the printing controller in succession, with a total number of the issued special-print-commands exceeding an upper limit, at the calculated scheduled-time of nozzle-cleaning operation.

According to a fourteenth mode of the invention, there is provided a network-attached recording system having a plurality of recording devices and a common terminal equipment which is communicatable with the plurality of recording devices via a network, and capable of selectively using the plurality of recording devices thereby printing an image on a recording medium, in response to entry of a print command through the terminal equipment, wherein the plurality of recording devices includes at least one inkjet recording device, each of the at least one inkjet recording device comprises:

a printhead having a plurality of inkjet nozzles for firing ink droplets therethrough;

a printing controller arranged to operate, upon reception of the print command, to selectively activate the plurality of inkjet nozzles to fire ink droplets, thereby performing a printing operation for printing an image on a recording medium;

a nozzle-cleaning controller arranged to activate the plurality of inkjet nozzles to fire ink droplets, thereby performing a nozzle cleaning operation for removing performance-degrading factors from the plurality of inkjet nozzles;

a nozzle-cleaning-time calculator arranged to calculate a scheduled time of a next nozzle-cleaning operation which succeeds a time instant at which a last firing operation was implemented by the printhead, by a predetermined reference-time-interval;

a nozzle-cleaning activator arranged to activate the nozzle-cleaning controller if a current time reaches the calculated scheduled-time of nozzle-cleaning operation; and a reference-time-instant calculator arranged to calculate a reference time instant for the at least one inkjet recording device, as a time instant preceding the calculated scheduled-time of nozzle-cleaning operation by a predetermined time period, on a per-inkjet-recording-device basis, and the terminal equipment comprises a selector arranged to perform an operation concerning selection of one of the at least one inkjet recording device which has a calculated reference-time-instant that has been reached, as a target recording-device to be activated in response to entry of the print command through the terminal equipment.

In this network-attached recording system, a plurality of recording devices including at least one inkjet recording device are attached to a network (e.g., a LAN, a WAN, the Internet, or an intranet), and a user is allowed to selectively use the plurality of recording devices, from a terminal equipment (e.g., a personal computer) common to the plurality of recording devices.

In this regard, the "selector" may be configured, for example, to perform an operation that is conducive to selection of the inkjet recording device which has a calculated reference-time-instant that has been reached, as the target recording-device.

Such an operation may be defined as, for example, a first operation to select the inkjet recording device which has a calculated reference-time-instant that has been reached, as the target recording-device, subject to at least partial user-intervention, or a second operation to select the inkjet recording device which has a calculated reference-time-instant that has been reached, as the target recording-device, without user intervention, that is to say, automatically.

Once an example of the first operation is performed, a user is notified that the inkjet recording device which has a calculated reference-time-instant that has been reached is a recommended recording device, and the inkjet recording device in question is selected as the target recording device, subject to a user intent to select the inkjet recording device in question as the target recording device.

In an example of this network-attached recoding system, when, among the plurality of recording devices, the inkjet recording device is scheduled to initiate a next nozzle-cleaning operation (i.e., preliminary firing) soon or in a short while, a user is notified that the inkjet recording device in question is recommended as a recording device which is to be used for eliminating the occurrence of the next nozzle-cleaning operation.

This makes it easier for a user to correctly select one of the optional recording devices which is to be activated for eliminating the occurrence of a next nozzle-cleaning operation, resulting in easier prevention of a certain amount of ink from being wasted only for nozzle cleaning.

According to a fifteenth mode of the invention, A network-attached recording system having a plurality of recording devices and a common terminal equipment which is communicatable with the plurality of recording devices via a network, and capable of selectively using the plurality of recording devices thereby printing an image on a recording medium, in response to entry of a print command through the terminal equipment, wherein the plurality of recording devices include a plurality of inkjet recording devices, each of the plurality of inkjet recording devices comprises:

a printhead having a plurality of inkjet nozzles for firing ink droplets therethrough;

a printing controller arranged to operate, upon reception of the print command, to selectively activate the plurality of inkjet nozzles to fire ink droplets, thereby performing a printing operation for printing an image on a recording medium;

a nozzle-cleaning controller arranged to activate the plurality of inkjet nozzles to fire ink droplets, thereby performing a nozzle cleaning operation for removing performance-degrading factors from the plurality of inkjet nozzles;

a nozzle-cleaning-time calculator arranged to calculate a scheduled time of a next nozzle-cleaning operation which succeeds a time instant at which a last firing operation was implemented by the printhead, by a predetermined reference-time-interval; and a nozzle-cleaning activator arranged to activate the nozzle-cleaning controller if a current time reaches the calculated scheduled-time of nozzle-cleaning operation, and the terminal equipment comprises a recording-device selector arranged to perform an operation concerning selection of one of the plurality of inkjet recording devices which has the earliest one of scheduled-times of nozzle-cleaning operations calculated for the plurality of inkjet recording devices, respectively, as a target recording-device to be activated in response to entry of the print command through the terminal equipment.

In this regard, the "recording-device selector" may be configured, for example, to perform an operation that is conducive to selection of the inkjet recording device scheduled to initiate a next nozzle-cleaning operation at the earliest time instant among those of the plurality of inkjet recording devices, as the target recording-device.

Such an operation may be defined as, for example, an operation to select the inkjet recording device scheduled to initiate a next nozzle-cleaning operation at the earliest time, as the target recording-device, subject to at least partial user-intervention, or without user intervention, that is to say, automatically.

According to a sixteenth mode of the invention, there is provided a method of controlling an inkjet recording device having a printhead having a plurality of inkjet nozzles for firing ink droplets therethrough, the method comprising;

a printing step, upon reception of a print command, of selectively activating the plurality of inkjet nozzles to fire ink droplets, thereby performing a printing operation for printing an image on a recording medium;

a nozzle-cleaning step of activating the plurality of inkjet nozzles to fire ink droplets, thereby performing a nozzle cleaning operation for removing performance-degrading factors from the plurality of inkjet nozzles;

a step of calculating a scheduled time of a next nozzle-cleaning operation which succeeds a time instant at which a last firing operation was implemented by the printhead, by a predetermined reference-time-interval;

a step of implementing the nozzle-cleaning step if a current time reaches the calculated scheduled-time of nozzle-cleaning operation; and a frequency reduction step of performing an operation concerning a reduction in a frequency at which the nozzle-cleaning operation is repeated by the printhead, by monitoring the calculated scheduled-time of nozzle-cleaning operation, on a time-line basis.

According to a seventeenth mode of the invention, the inkjet recording device set forth in the sixteenth mode of the invention is used with at least one separate recording device for printing an image in a non-inkjet manner, whereby the inkjet recording device and the at least one separate recording device together constitute a plurality of recording devices, the plurality of recording devices are communicable with a common terminal equipment via a network, the plurality of recording devices are selectively used for printing an image on a recording medium, in response to entry of a print command through the terminal equipment, the frequency reduction step included in the sixteenth mode of the invention includes:

a sub-step of calculating a reference time instant for the inkjet recording device, as a time instant preceding the calculated scheduled-time of nozzle-cleaning operation by a predetermined time period; and a sub-step of performing an operation concerning selection of the inkjet recording device as a target recording-device to be activated in response to entry of the print command through the terminal equipment, if a current time reaches the reference time instant for the inkjet recording device.

Several presently preferred embodiments of the invention will be described in more detail by reference to the drawings in which like numerals are used to indicate like elements throughout.

First Illustrative Embodiment

Referring first to FIG. 1, there will be described a printing system constructed according to a first illustrative embodiment of the present invention.

Hardware Configuration

In FIG. 1, there is conceptually illustrated in block diagram the hardware configuration of the printing system constructed in accordance with the present embodiment.

As illustrated in FIG. 1, the printing system includes a network 10 (e.g., LAN), a plurality of PCs (Personal Computers) 12 and a plurality of printers 14 (denoted as "PRINTERS_01-04" in FIG. 1), with the PCs 12 and the printers 14 being coupled to the network 10.

Each PC 12, as is well-known, is configured to include a CPU (Central Processing Unit) 21; a ROM (Read Only Memory) 22; a RAM (Random Access Memory) 23; a network interface (hereinafter, referred to as "network I/F") 24; an user-operable device 25; a display device 26; and an HDD (Hard Disc Drive) 27, all of which are coupled to one another via a bus 28. In each PC 12, the CPU 21, the ROM 22, the RAM 23 and the bus 28 together construct a computer as a relevant portion of each PC 12.

The CPU 21 has total control over all components of the PC 12, while the ROM 22 has previously stored therein programs or the like which are to be executed by the CPU 21 for performing various operations. The RAM 23 is for storage of print data or the like generated by the CPU 21 during a printing operation. The network I/F 24 couples the CPU 21 and the network 10 to each other.

The user-operable device 25, which, although not shown, is in the form of a key board and/or a mouse, is configured to input a signal from user-operable switches. The display device 26, which, although not shown, is in the form of a Liquid Crystal Display, presents or displays to a user, messages or the like in text or graphics format. The HDD 27 has previously stored therein file data executable by an application program stored in the ROM 23.

Figure 9:
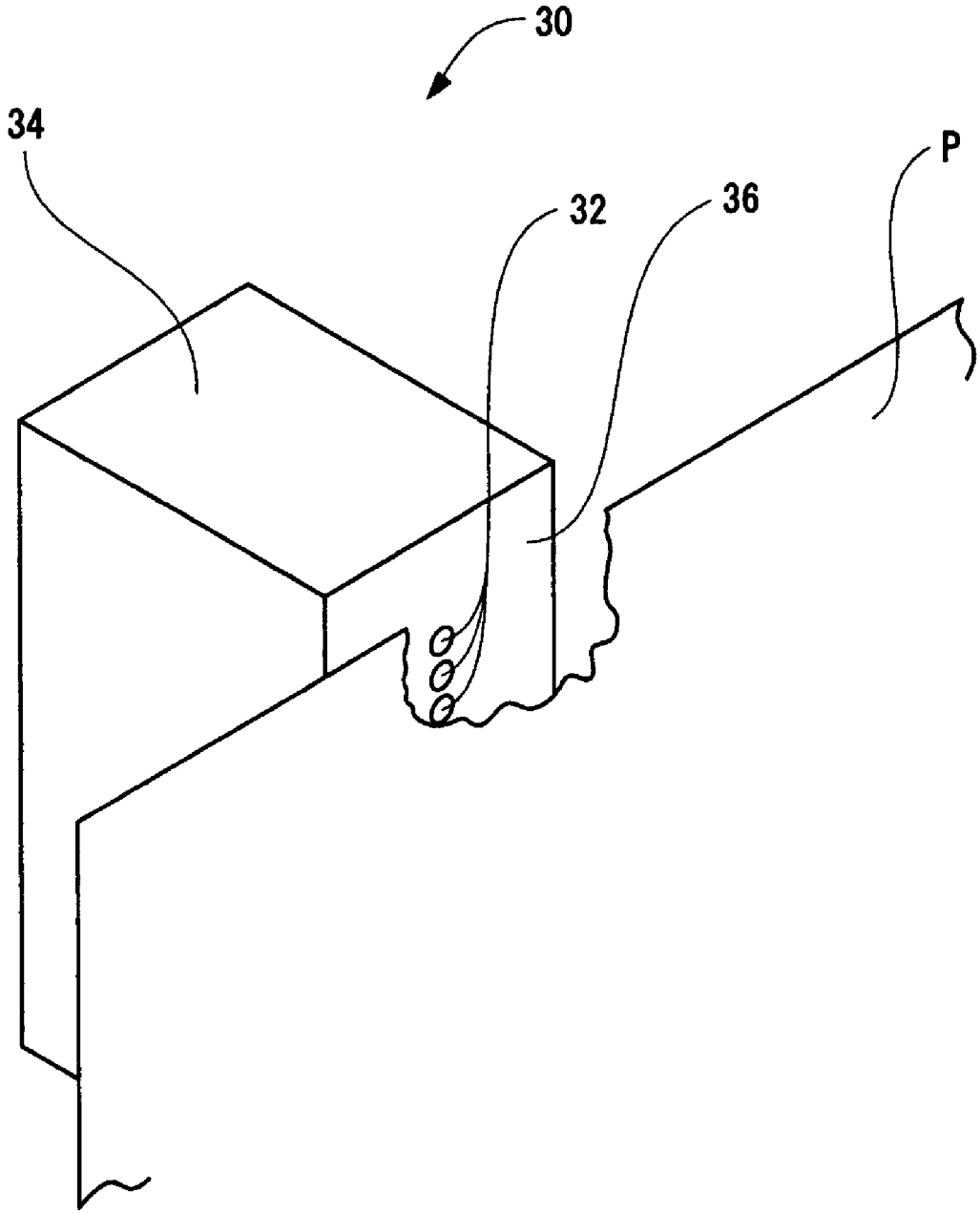
FIG. 9 is a perspective view illustrating a print mechanism depicted in FIG. 1.

On the other hand, each printer 14 coupled to the network 10 is of well-known inkjet-type. Each printer 14 includes a print mechanism 30. As illustrated in FIG. 9, the print mechanism 30 is provided with a printhead 34 having a plurality of inkjet nozzles 32 through which ink droplets are fired. These inkjet nozzles 32 are arrayed on a nozzle face 36 of the printhead 34.

The print mechanism 30, although not shown, further includes a mechanism (e.g., a carriage and a carriage motor) for moving the printhead 34 back and forth relative to a print sheet P in its widthwise direction, with the printhead 34 confronting the print sheet P, and a mechanism for advancing the print sheet P in its lengthwise direction.

A printer including an exemplary embodiment of the print mechanism 30 is disclosed in U.S. Pat. No. 5,574,485, which is incorporated herein by reference in its entirety.

The print mechanism 30, although not shown, still further includes a cleaning mechanism for cleaning the inkjet nozzles 32 by sucking ink droplets therefrom. An exemplary embodiment of such a cleaning mechanism is also disclosed in the above-mentioned U.S. Pat. No. 5,574,485.

Each printer 14 further includes a CPU 41 having total control over a plurality of components of each printer 14, and a ROM 42. The ROM 42 has previously stored therein programs to be executed by the CPU 41 for performing various operations, and device information of the printer 14.

Each printer 14 still further includes a RAM 43; a network I/F 44 for coupling the CPU 41 and the network 10 to each other; and a bus 44*a* for mutual connection of these components. The RAM 43 acts as a storage area for data generated by the CPU 41 during various operations, and as a storage area during various operations by the CPU 41. In each printer 14, the CPU 41, the ROM 42, the RAM 43 and the bus 44*a* together construct a computer as a relevant portion of each printer 14.

To the bus 44*a* of each printer 14, there are further coupled a user-operable device 45, a display device 46, a non-volatile RAM 47, the print mechanism 30, etc.

The user-operable device 45 is adapted to input a signal through user-operable switches (not shown) for control of the printer 14. The display device 46 is adapted to present or display the status of the printer 14; a list of sets of print data, error information or the like which are to be transmitted from the PC 12; or the like, each in response to a respective command from the CPU 41.

In operation, the print mechanism 30 activates the inkjet nozzles 32 of the printhead 34 to fire ink droplets therefrom, in response to a command issued from the CPU 41, to thereby print an image on a print sheet P.

The non-volatile RAM 47 of each printer 14 has stored therein various settings information pre-set by a user. The various settings information includes, for example:

a preliminary-firing interval "Δt" (e.g., ten hours);

a notification period "ΔtN" (e.g., one hour);

an inhibition time range for notification (e.g., a range from 00 (hour):00 (minute):00 (second) to 05 (hour):00 (minute):00 (second)); and the type of an operation (i.e., either preliminary firing or normal firing for printing) to be implemented when a scheduled time instant of preliminary firing is reached.

It is added that, in the present embodiment, a time instant is denoted as an absolute time instant (i.e., a date/time or a date (month, day and year) and a time of day) in units of seconds. For a better understanding of the present embodiment, however, a time instant is denoted with the minutes and the seconds provided as zero and therefore omitted in the description.

General Overview of Software Configuration

Figure 2:
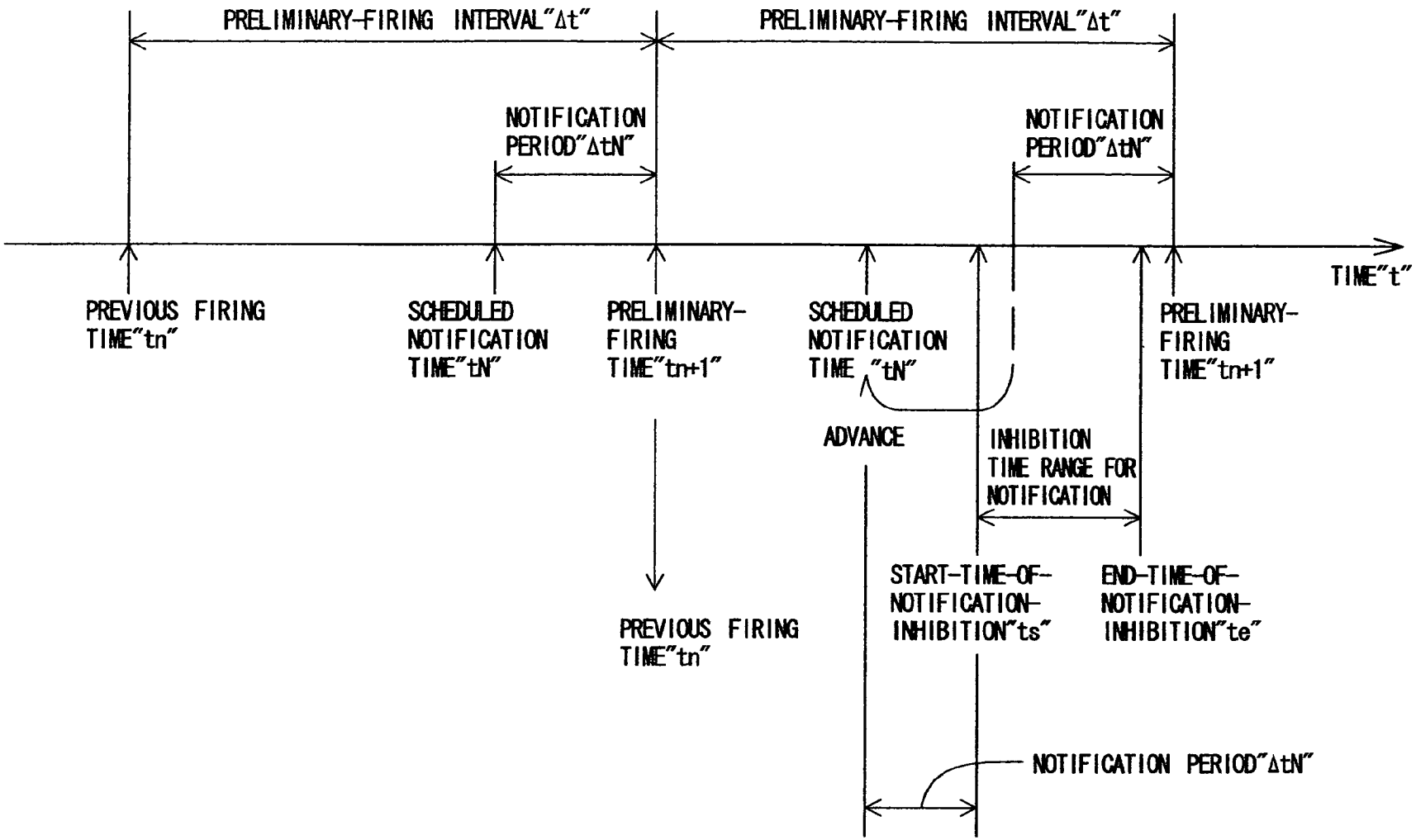
FIG. 2 is a time chart illustrating step-by-step successive events occurring in each printer included in the printing system depicted in FIG. 1.

In FIG. 2, successive operations of each printer 14 are illustrated step-by-step on a time-line basis. There will be schematically described the successive operations of each printer 14 by reference to FIG. 2.

Each printer 14 selectively performs a printing operation and a preliminary firing operation (i.e., a nozzle-cleaning operation), for activating the printhead 34.

During the printing operation, the print mechanism 30 performs an operation corresponding to a print command issued from the CPU 41, to thereby selectively activate the inkjet nozzles 32 to fire ink droplets, based on print data corresponding to the print command. As a result, an image is printed based on the print data on a print sheet P.

On the other hand, when no ink droplets has been fired from the inkjet nozzles 32 for a predetermined time period, the preliminary firing operation is implemented to remove performance-degrading factors (e.g., bubbles, debris, clogs, deposits, and residues) from the inkjet nozzles 32.

During the preliminary firing operation, although not shown, the inkjet nozzles 32 are sealed by a cap which is connected to a pump, and, in this capped state, application of suction or the like by the pump causes ink droplets to be fired from all the inkjet nozzles 32.

In each printer 14, there is temporarily stored in the RAM 43 an ink firing time (i.e., a previous firing time) "tn" at which ink droplets were fired from the inkjet nozzles 32 as a result of the implementation of one of the printing operation and the preliminary firing operation.

A scheduled time instant of next preliminary-firing (hereinafter, abbreviated to "next preliminary-firing time") "tn+1" is calculated as a time instant which succeeds the ink firing time "tn" (i.e., a previous firing time) by the preliminary-firing interval "Δt." The ink firing time "tn" has been stored in the RAM 43, while the preliminary-firing interval "Δt" has been stored in the non-volatile RAM 47. The preliminary-firing interval "Δt" is an example of the aforementioned "reference-time-interval."

A scheduled notification time (an instant of time) "tN" is calculated as a time instant which precedes the calculated next preliminary-firing time "tn+1" by the notification period "ΔtN." The notification period "ΔtN" has been stored in the non-volatile RAM 47. The scheduled notification time "tN" and a current time "t0" is compared with each other, and, if the current time "t0" reaches the scheduled notification time "tN," then a particular notification is provided to the user.

When the inhibition time range for notification has been stored in the non-volatile RAM 47, and when the scheduled notification time "tN" is within the inhibition time range for notification, the scheduled notification time "tN" is changed to a time instant which precedes a start time of the inhibition time range for notification (hereinafter, referred to as "start-time-of-notification-inhibition "ts"") stored in the non-volatile RAM 47, by the notification period "ΔtN."

The inhibition time range for notification is pre-set by a user as a time range during which the user cannot notice any notification even if provided, such as a late-night time range. An example of the inhibition time range for notification is a time range from 0 AM to 5 AM, as described above.

Then, the algorithm for calculating preliminary firing times and notification times will be described below in greater detail through an example.

In this example, the preliminary-firing interval Δt is pre-set as ten hours, the notification period ΔtN is pre-set as one hour, and the inhibition time range for notification is pre-set as a time range from 0 AM to 4 AM.

Accordingly, in this example, if, for example, one of a printing operation and a preliminary firing operation (ideally, the preliminary firing operation) is implemented at 6 AM, then the next preliminary-firing time "tn+1" is calculated as 4 PM which is ten hours after the implementation of one of a printing operation and a preliminary firing operation. Further, the scheduled notification time "tN" is calculated as 3 PM which is one hour before the next preliminary-firing time "tn+1."

In this instance, if a next printing operation is implemented at a time instant during a period from 3 PM to 4 PM, then the next preliminary-firing time "tn+1" is calculated as a time instant which is ten hours after the implementation of the printing operation.

In contrast, if a next printing operation is not implemented during a period from 3 PM to 4 PM, then next preliminary firing is performed at 4 PM as scheduled, and the next preliminary-firing time "tn+1" is calculated as 2 AM of the next day which is ten hours after the implementation of the preliminary firing. Further, the scheduled notification time tN is calculated as 1 AM which is one hour before the next preliminary-firing time "tn+1."

In this example, a time instant of 1 AM is within the inhibition time range for notification, and therefore, a rescheduled notification time "tN" is set as 11 PM which precedes 0 AM (i.e., a set value of the start-time-of-notification-inhibition "ts") by the notification period "ΔtN" (e.g., one hour).

At 11 PM, a notification is provided to a user to the effect that a preliminary firing operation will start soon. The notification is provided to the user at the rescheduled notification time "tN" which is equal to a time instant preceding the start-time-of-notification-inhibition time "ts" by the notification period "ΔtN."

As a result, even where the original scheduled notification time "tN" is within the inhibition time range for notification, a time period which lasts until the start-time-of-notification-inhibition time "ts," that is to say, until the user finishes using this printer 14 is maintained as a notification period for the user which has the same length as that of the notification period "ΔtN." During this period, the user is allowed to issue a print command to the printer 14 in order to eliminate next preliminary firing.

It is added that the preliminary-firing interval "Δt," the notification period "ΔtN" and the inhibition time range for notification, all of which are to be stored in the non-volatile RAM 47, may be set by preceding user manipulation to either the user-operable device 45 of the printer 14 or the user-operable device 25 of the PC 12.

A notification may be provided to the user in any type that allows the user to perceive, such as a type of activating a buzzer (an exemplary audible alarm), a type of blinking a light (an exemplary visible alarm), or a type of displaying a message (another exemplary visible alarm). In addition, a notification may also be provided to the user in a type of vibrating a mouse (an exemplary tactual alarm).

A device (i.e., a notifier) for providing a notification to a user may be the printer 14 or the PC 12, or a device separate from them. In an example where a notification is provided to the user by means of the display device 26 of the PC 12, the display device 26 may be configured to display an icon or the like indicative of the printer 14.

In an example where a clock is always displayed to indicate a current time on the display device 26 of the PC 12 and/or the display device 46 of the printer 14, representation of a scheduled time of preliminary firing in combination with that clock on a display screen would allow the user to easily perceive the extent of a temporal distance of a next preliminary firing time from a current time, such as how far in the future next preliminary firing is to occur.

In another example where a notification is provided to the user by means of the display device 26 of the PC 12 and/or the display device 46 of the printer 14, the present invention may be practiced such that a message is displayed to the user to the effect that preliminary firing will start soon, for example.

In this example, the present invention may be alternatively practiced such that, in addition to the above-mentioned message, a second message is displayed to the user to the effect that, if a user uses this printer for printing, then next preliminary firing time will be delayed. This arrangement makes it easier for the user to correctly appreciate the notification provided to the user.

In still another example where a notification is provided to the user by means of the display device 26 of the PC 12, the present invention may be practiced such that, in addition to the notification, status information of the printer 14 is displayed to the user. This arrangement allows the user to become aware of also the status of the printer 14 as to whether or not the printer 14 is ready to start soon (e.g., whether or not there is no print sheet available, etc.).

Ink Firing Operation

Figure 3:
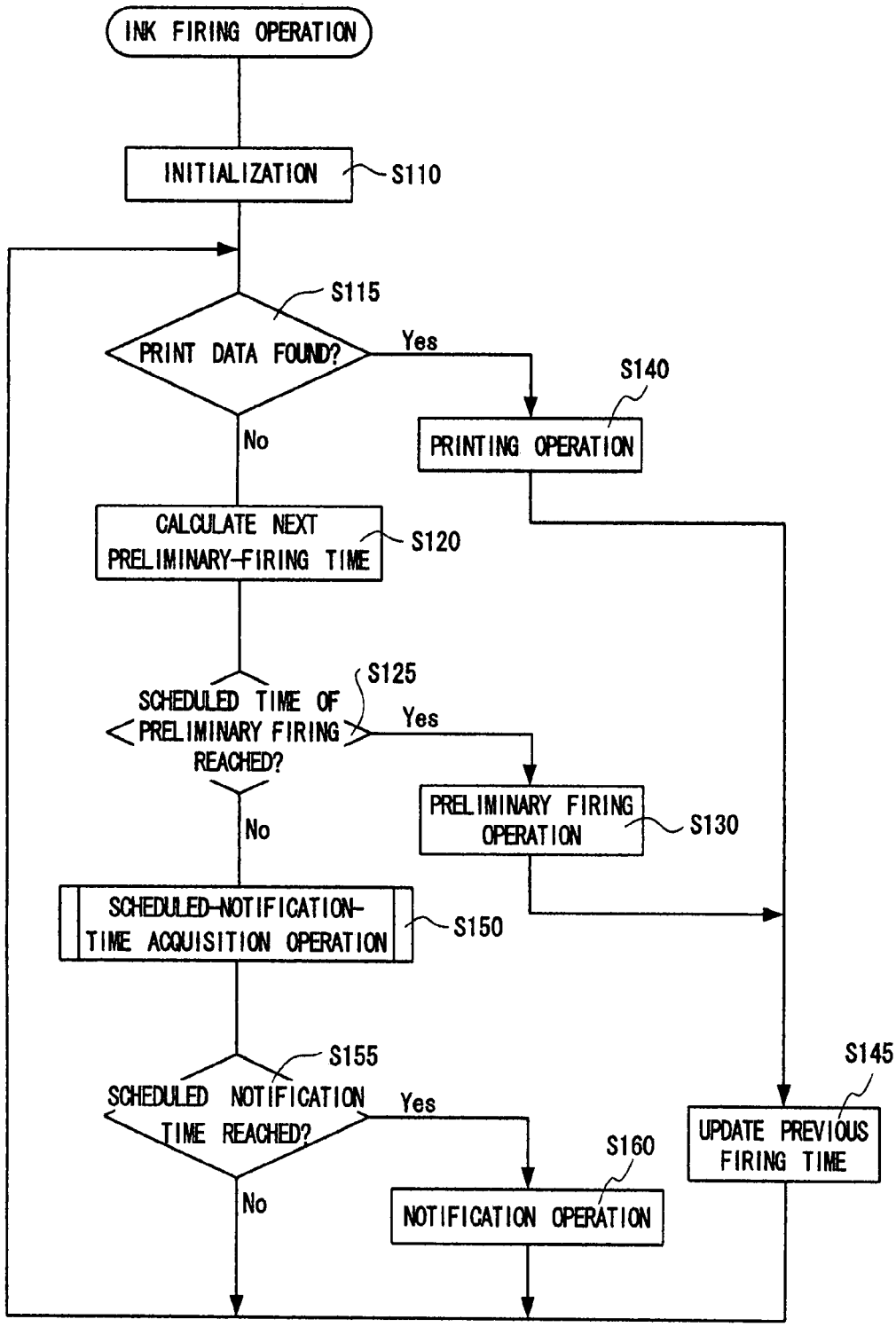
FIG. 3 is a flow chart conceptually illustrating an ink-firing operation program to be executed by a computer which is incorporated in each printer depicted in FIG. 1 for performing an ink-firing operation as a main operation by each printer.

Next, an operational action of each printer 14 will be described by referring to flow charts of FIGS. 3 and 4. FIG. 3 conceptually illustrates in flow chart an ink-firing operation program to be executed by the CPU 41.

Upon power-on of the printer 14, the CPU 41 executes the ink-firing operation program illustrated in FIG. 3, to initiate an ink firing operation.

During the ink firing operation, a previous firing time "tn" is first initialized (step S110). More specifically, the previous firing time "tn" (i.e., a firing time to be referenced merely for the computational purpose, currently) is set as a time instant obtained by subtracting the preliminary-firing interval "Δt" from the current time "t0" (tn=t0−Δt). The thus-set previous-firing-time "tn" is stored in the RAM 43.

Subsequently, a determination is made as to whether or not print data is present (step S115). That is to say, a determination is made as to whether the PC 12 has issued a print instruction in response to entry of a print command from the user, and the printer 14 has received print data from the PC 12.

If it is determined that print data is not present ("No" branch of step S115), then the next preliminary-firing time (i.e., a scheduled time of next preliminary-firing time) "tn+1" is calculated (step S120). This next preliminary-firing time "tn+1" is a time instant obtained by adding the preliminary-firing interval "Δt" to the previous firing time "tn."

If it is immediately after the printer 14 is powered on, then the next preliminary-firing time "tn+1" is calculated by adding the preliminary-firing interval "Δt" to the previous firing time "tn" which has been set by the above-described initialization. The resulting value of the next preliminary-firing time "tn+1" is equal to the current time "t0." The calculated next-preliminary-firing-time "tn+1" is stored in the RAM 43.

After calculation, a determination is made as to whether or not the next preliminary-firing time "tn+1" has been reached, that is to say, the current time "t0" has reached the next preliminary-firing time "tn+1" (step S125).

If it is determined that the next preliminary-firing time "tn+1" has been reached ("Yes" branch of step S125), then a preliminary firing operation is performed (step S130). More specifically, as described above, the cap (not shown) seals the nozzle face 36, to thereby suck ink droplets from all the inkjet nozzles 32.

As a result, preliminary firing is implemented inevitably upon power-on of each printer 14. When the printer 14 has been situated in a power-off state for such a long time that the surface of the printhead 34 or the nozzle face 36 is dried and ink droplets collected therein is thickened, the inevitable implementation of preliminary firing allows performance-degrading factors to be removed from the inkjet nozzles 32.

Upon termination of preliminary firing, the previous firing time "tn" is updated so as to be equal to the current time "t0" (step S145), in preparation for a next calculation cycle of the next preliminary-firing time "tn+1" (i.e., next implementation of step S120). The updated previous-firing-time "tn" is stored in the RAM 43. Thereafter, this operation returns to step S115.

If, however, it is determined that print data is present, that is, the PC 12 has issued a print instruction and the printer 14 has received print data from the PC 12 ("Yes" branch of step S115"), then a printing operation is performed (step S114).

More specifically, based on the print data corresponding to the print instruction, ink droplets are ejected from the inkjet nozzles 32 via the print mechanism 30, to form an image on a print sheet P.

Subsequently, the previous firing time "tn" is updated so as to be equal to the current time "t0" (step S145), in preparation for a next calculation cycle of the next preliminary-firing time "tn+1" (i.e., next implementation of step S120). The updated previous-firing-time "tn" is stored in the RAM 43. Thereafter, this operation returns to step S115.

Scheduled-Notification-Time Acquiring Operation

If, however, it is determined that the next preliminary-firing time "tn+1" has not been reached ("No" branch of step S125), then a scheduled-notification-time acquiring operation is performed (step S150). For this operation to be performed, the CPU 41 executes a scheduled-notification-time acquisition program which is conceptually illustrated in flow chart in FIG. 4.

During the scheduled-notification-time acquiring operation, the scheduled notification time "tN" is first calculated at steps S210 and S220.

More specifically, the next preliminary-firing time "tn+1" is first calculated as a time instant obtained by adding the preliminary-firing interval "Δt" to the previous firing time "tn" (which has been stored in the RAM 43) (step S210).

It is added that, at step S210, the next preliminary-firing time "tn+1" may be acquired by retrieval of the next preliminary-firing time "tn+1" from the RAM 43.

Subsequently, the notification period "ΔtN" is subtracted from the next preliminary-firing time "tn+1," to thereby calculate the scheduled notification time "tN" (step S220).

Thereafter, a determination is made as to whether or not the calculated scheduled-notification-time "tN" is before the start-time-of-notification-inhibition "ts" (step S230).

If it is determined that calculated scheduled-notification-time "tN" is before the start-time-of-notification-inhibition "ts" ("Yes" branch of step S230), then the execution of this scheduled-notification-time acquisition program is immediately terminated, because the scheduled notification time "tN" is not within the inhibition time range for notification.

If, however, it is determined that the scheduled notification time "tN" is after the start-time-of-notification-inhibition "ts" ("No" branch of step S230), then a determination is made as to whether or not the scheduled notification time "tN" is after an end time of the inhibition time range for notification (hereinafter, referred to as "end-time-of-notification-inhibition "te"") (step S240).

If it is determined that the scheduled notification time "tN" is after the end-time-of-notification-inhibition "te" ("Yes" branch of step S240), then the execution of this scheduled-notification-time acquisition program is immediately terminated, because the scheduled notification time "tN" is not within the inhibition time rage for notification.

If, however, it is determined that the scheduled notification time "tN" is before the end-time-of-notification-inhibition "te" ("No" branch of step S240), then the scheduled notification time "tN" is recalculated (step S250), because the scheduled notification time "tN" is within the inhibition time range for notification.

At step S250, a currently-set value of the scheduled notification time "tN" is replaced with a value of the scheduled notification time "tN" which precedes the start-time-of-notification-inhibition "ts" by the notification period "ΔtN."

Figure 4:
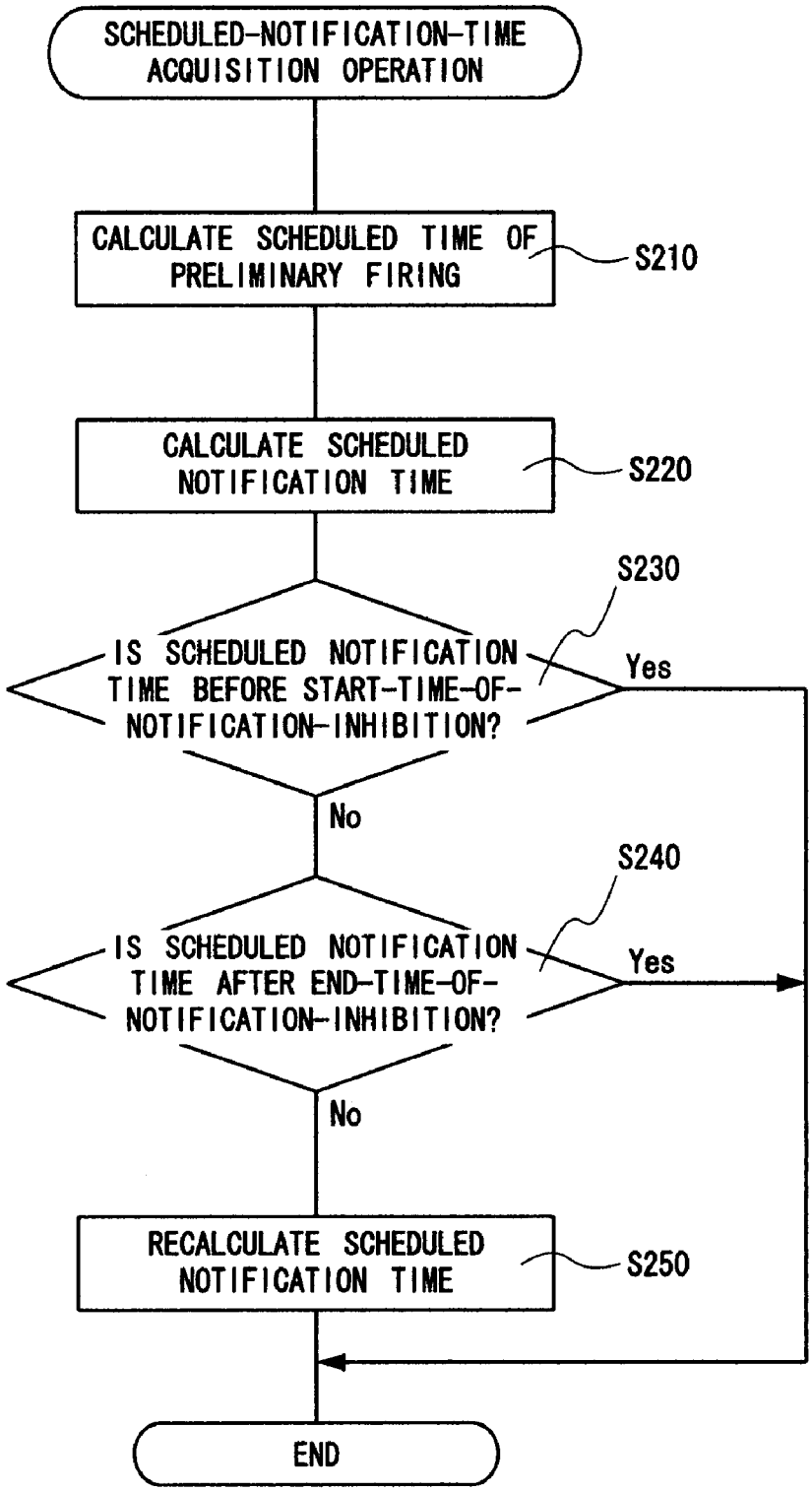
FIG. 4 is a flow chart conceptually illustrating the detail of step S150 depicted in FIG. 3 as a scheduled-notification-time acquisition program.

It is added that each printer 14 performs the scheduled-notification-time acquiring operation illustrated in FIG. 4 also upon reception of a request for scheduled-notification-time from the PC 12.

Thereafter, at step S155 illustrated in FIG. 3, a determination is made as to whether or not the current time "t0" has reached the scheduled notification time "tN" which has been previously set at step S150 (i.e., step S220 or S250 in the scheduled-notification-time acquiring operation illustrated in FIG. 4).

If it is determined that the current time "t0" has not reached the scheduled notification time "tN" ("No" branch of step S155), then this operation returns to step S115 again.

If, however, it is determined that the current time "t0" has reached the scheduled notification time "tN" ("Yes" branch of step S155), then the display device 26 of the printer 14 or the display device 46 of the PC 12 is instructed to perform an operation for providing to a user a notification (representation) to the effect that the printer 14 will start the preliminary firing soon.

Upon issuance of a print command to the printer 14 from a user who has just viewed the notification provided, a printing operation is initiated. It follows that the previous firing time "tn" is updated at step S145 without the necessity of implementing preliminary firing (as if preliminary firing were implemented), with an extension of a time-period terminating at an actual time of a possible next preliminary-firing. This results in a reduction in how often or how much ink droplets are wasted for preliminary firing.

As will be evident from the foregoing, in the present embodiment, a portion of the CPU 41, the ROM 42 and the RAM 43 of each printer 14 (which together construct the relevant part of the computer) which is assigned to execute steps S115 and S140 illustrated in FIG. 3, illustratively, constitutes an example of the "printing controller" set forth in the above-described first mode of the invention, and a portion of the CPU 41, the ROM 42 and the RAM 43 which is assigned to execute step S130 illustrated in FIG. 3, illustratively, constitutes an example of the "nozzle-cleaning controller" set forth in the same mode.

Further, in the present embodiment, a portion of the CPU 41, the ROM 42 and the RAM 43 which is assigned to execute steps S120 and S145 illustrated in FIG. 3, illustratively, constitutes an example of the "calculator" set forth in the above-described first mode of the invention, a portion of the CPU 41, the ROM 42 and the RAM 43 which is assigned to execute step S125 illustrated in FIG. 3, illustratively, constitutes an example of the "nozzle-cleaning activator" set forth in the same mode, and a portion of the CPU 41, the ROM 42 and the RAM 43 which is assigned to execute steps S150, S155 and S160 illustrated in FIG. 3, illustratively, constitutes an example of the "frequency reducer" set forth in the same mode.

Still further, in the present embodiment, a portion of the CPU 41, the ROM 42 and the RAM 43 which is assigned to execute step S150 illustrated in FIG. 3, illustratively, constitutes an example of the "calculating section" set forth in the above-described fifth mode of the invention, and a portion of the CPU 41, the ROM 42 and the RAM 43 which is assigned to execute steps S150 and S160 illustrated in FIG. 3, illustratively, constitutes an example of the "notifier" set forth in the same mode.

Yet still further, in the present embodiment, a portion of the CPU 41, the ROM 42 and the RAM 43 of each printer 14 which is assigned to execute step S150 illustrated in FIG. 3, illustratively, constitutes an example of the "calculating section" set forth in the above-described sixth mode of the invention, a portion of the CPU 41, the ROM 42 and the RAM 43 which is assigned to execute step S155 illustrated in FIG. 3, illustratively, constitutes an example of the "comparator" set forth in the same mode, and a portion of the CPU 41, the ROM 42 and the RAM 43 which is assigned to execute step S160 illustrated in FIG. 3, illustratively, constitutes an example of the "alarm activator" set forth in the same mode.

Additionally, in the present embodiment, the user-operable devices 25 and 45, illustratively, each constitute an example of the "pre-setter" set forth in the above-described seventh mode of the invention, and a portion of the CPU 41, the ROM 42 and the RAM 43 of each printer 14 which is assigned to execute steps S230-S250 illustrated in FIG. 4, illustratively, constitutes an example of the "notification inhibitor" set forth in the same mode.

Still additionally, in the present embodiment, the user-operable devices 25 and 45, illustratively, each constitute an example of the "pre-setter" set forth in the above-described eighth mode of the invention, and a portion of the CPU 41, the ROM 42 and the RAM 43 of each printer 14 which is assigned to execute steps S230-S250 illustrated in FIG. 4, illustratively, constitutes an example of the "changer" set forth in the same mode.

Second Illustrative Embodiment

Next, a printing system in accordance with a second illustrative embodiment of the present invention will be described.

The present embodiment, however, has many elements in common to those of the first embodiment, and therefore the common elements of the present embodiment will be referenced the same reference numerals or names as those of the first embodiment, without redundant description and illustration, while only the distinctive elements of the present embodiment will be described below in detail with reference to FIG. 5.

In the first embodiment, application programs various in content are executed in the respective printers 14 for providing to a user an advance notice of next preliminary firing.

In contrast, in the printing system constructed according to the present embodiment, an application program has been installed in the PC 12 for performing a recommended-printer display operation by globally monitoring the plurality of printers 14 coupled to the network 10.

More specifically, the PC 12 has a function of selecting an appropriate one of the plurality of printers 14 which is to be activated for reducing the frequency of preliminary firing and recommending the selected printer 14 to the user.

To this end, a certain application program has been installed in the PC 12 as a resident software program. This application program is to be executed for recommending to the user that one of the plurality of printers 14 be selected for performing a next printing operation. The selected one printer 14 has been assigned a scheduled notification time "tN" (an example of the "reference time instant") which has been reached.

This application program is initiated with a step to cause the PC 12 to make an inquiry to each printer 14. Upon reception of the inquiry from the PC 12, each printer 14 transmits to the PC 12 the scheduled notification time "tN" which has been calculated and stored therein.

In the PC 12, a determination is made as to whether or not the current time "t0" has reached the scheduled notification time "tN," per each printer 14. If, for one of the printers 14, it is determined that the current time "t0" has reached the scheduled notification time "tN," then the user is visually notified that one of the printers 14 which has been assigned a scheduled notification time "tN" that has been reached is a target printer (i.e., a recommended printer).

Recommended-Printer Display Operation

Figure 5:
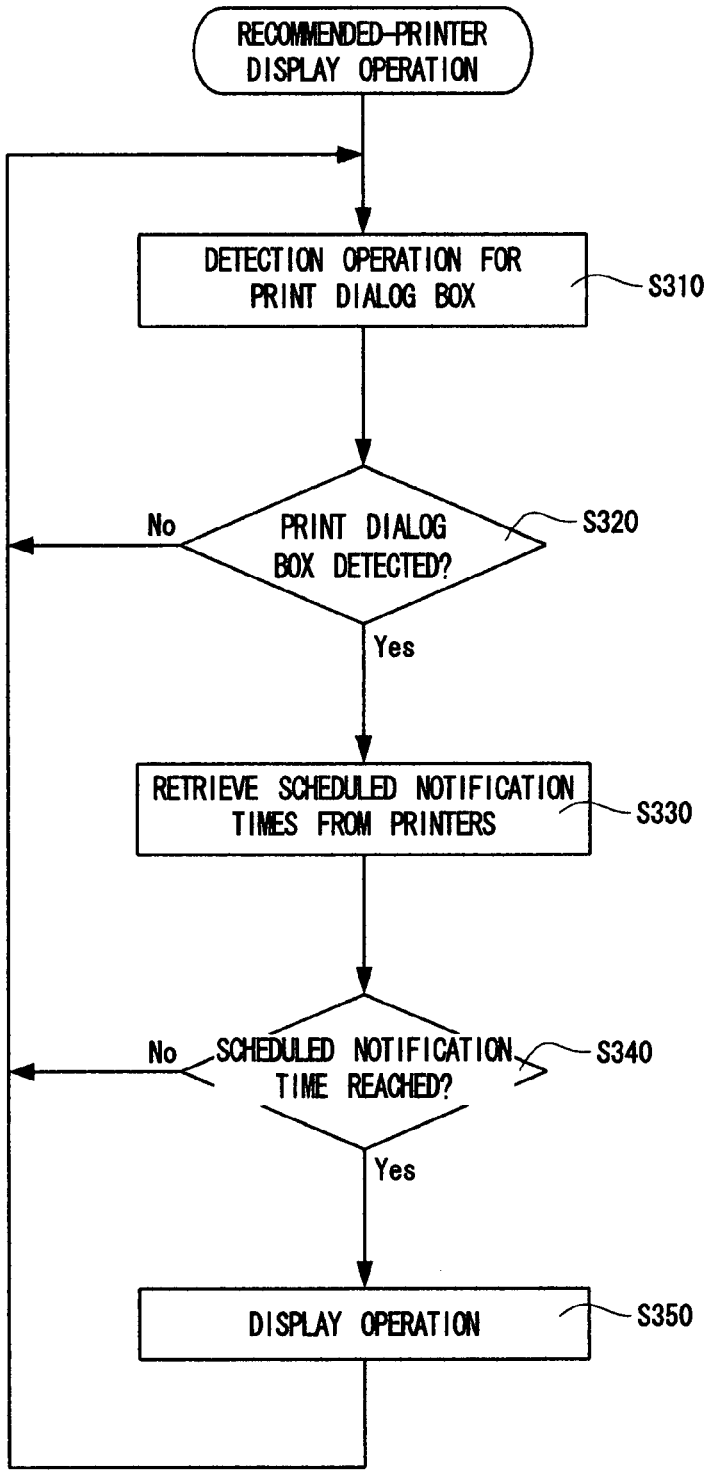
FIG. 5 is a flow chart conceptually illustrating a recommended-printer display-operation program to be executed by a computer unit of a PC (Personal Computer) included in a printing system constructed according to a second illustrative embodiment of the invention, the recommended-printer display-operation program being executed for performing a recommended-printer display operation by the PC.

Referring next to FIGS. 5 and 6, a recommended-printer display operation of the PC 12 will be described. FIG. 5 conceptually illustrates in flow chart a recommended-printer display-operation program to be executed by the CPU 21 for causing the PC 12 to perform the recommended-printer display operation.

During the recommended-printer display operation, upon installation of a pertinent application program in the PC 12, a detection operation for a print dialog box is performed repeatedly ("No" branches of steps S310 and S320).

At step S310, the detection operation for a print dialog box is performed. More specifically, for example, while the PC 12 is executing one of previously-installed application programs which has been specified for execution by the user, the status of the display device 26 is monitored as to whether or not an operation has been performed for displaying the print dialog box on the display device 26 in response to a print instruction from the user through the currently-executed application program.

In other words, during the execution of the currently-specified application program, the status of a user action is monitored as to whether or not the user has issued a print command to the PC 12.

If the print dialog box is detected as being currently displayed ("Yes" branch of step S320), then an operation is performed for acquiring the scheduled notification time "tN" from each printer 14 (step S330).

More specifically, first, a request for the scheduled notification time "tN" is made to each printer 14. Each printer 14, upon reception of the request, performs the scheduled-notification-time acquiring operation illustrated in FIG. 4, to thereby respond to the PC 12 with the scheduled notification time "tN" which has been acquired as a result of the implementation of the scheduled-notification-time acquiring operation. The scheduled notification time "tN" is transmitted from each printer 14 and is then received by the PC 12.

Thereafter, a determination is made as to whether or not the current time "t0" has reached the scheduled notification time "tN" which has been transmitted from each printer 14 (step S340). If it is determined that the current time "t0" has not reached the scheduled notification time "tN" ("No" branch of step S340), then this operation returns to step S310 to perform the detection operation for a print dialog box again.

If, however, it is determined that the current time "t0" has reached the scheduled notification time "tN" ("Yes" branch of step S340), then there is provided to the user through the display device 26 of the PC 12, a notification to the effect that the printer 14 is scheduled to initiate the preliminary firing soon (step S350).

Figure 6A:
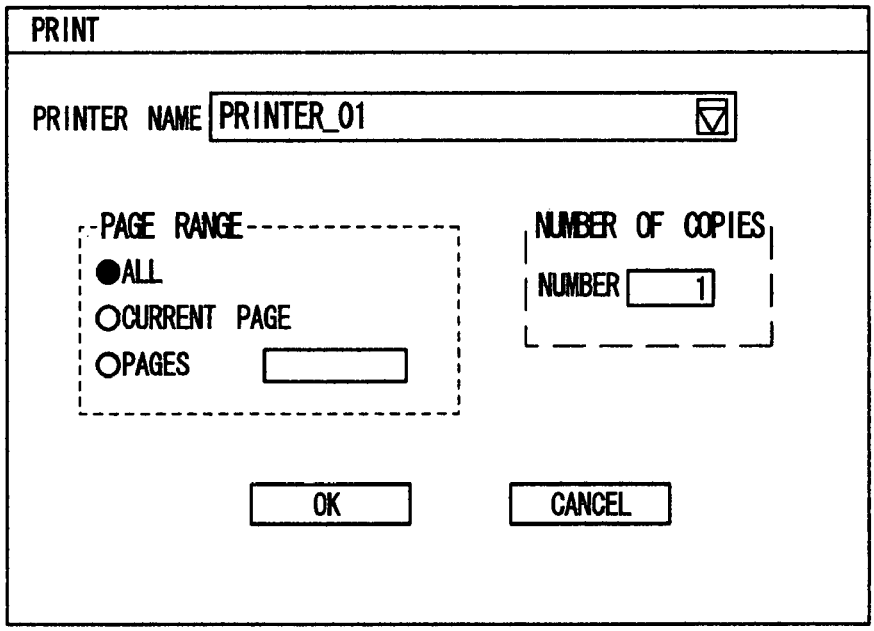
FIGS. 6A and 6B are views illustrating examples of screen pages displayed in a display device in the PC during printing, as a result of the implementation of step S350 depicted in FIG. 5.

More specifically, when a "PRINTER_01" has been set as a default printer, if the print dialog box is detected ("Yes" branch of step S320), then the print dialog box is displayed on the display device 26 of the PC 12 in such a manner as illustrated in FIG. 6A.

At this time, the "PRINTER_01" is displayed as a "printer name" of a target printing device in the print dialog box. This makes the user to appreciate that a printing operation by the currently-displayed printer 14 is to follow.

If the user depresses an "OK" button immediately, then a printing operation is performed by the "PRINTER_01" in accordance with the settings.

If, however, the user depresses the "OK" button after selection of a different printer 14 from a pull-down menu, then a printing operation is performed by the selected printer 14.

Figure 6B:
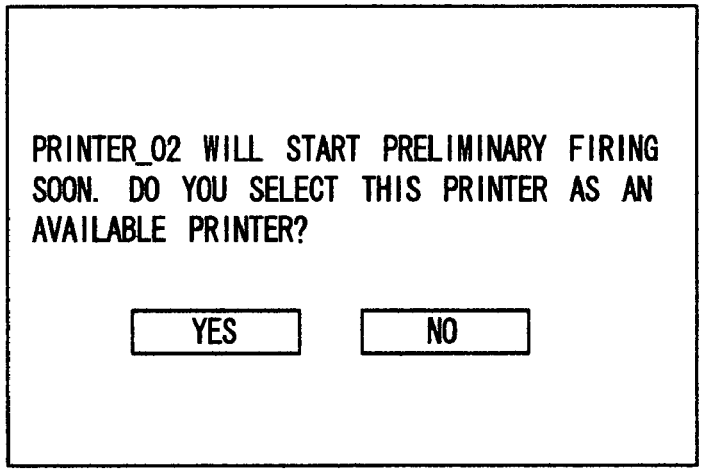

During the implementation of the recommended-printer display operation with a "PRINTER_02" being displayed as a target printing device, if a current time has reached the scheduled notification time "tN" for advance notice of preliminary firing of this printer 14 ("Yes" branch of step S340 in FIG. 5), then a message dialog box pops up and displays a certain message and "Yes"/"No" buttons as illustrated in FIG. 6B, separately from the print dialog box illustrated in FIG. 6A.

In the message dialog box, if the user depresses the "Yes" button, then the content of the "printer name" in the print dialog box illustrated in FIG. 6A is changed to the "PRINTER_02," followed by automated modification of the print settings to allow a printing operation by this "PRINTER_02" to follow.

This arrangement allows the user to select, at the point of printing, without the need of complicated user action, one of the plurality of printers 14 which is scheduled to initiate preliminary firing soon, as the target printing device. This results in the initiation of a printing operation by the selected printer 14.

As will be evident from the foregoing explanation, in the present embodiment, each PC 12, illustratively, constitutes an example of the "terminal equipment" set forth in the above-described fourteenth mode of the invention, and a portion of each PC 12 which is assigned to execute steps S310-S350 illustrated in FIG. 5, illustratively, constitutes an example of the "selector" set forth in the same mode and an example of the "frequency reducer" set forth in the above-described first mode of the invention.

It is noted that the recommended-printer display operation according to the present embodiment may be performed in the first embodiment together with the ink-firing operation and the scheduled-notification-time acquiring operation. In this instance, a message (e.g., "preliminary firing will start soon") according to the first embodiment is displayed on the display device 46 of each printer 14, while such message dialog boxes as illustrated in FIGS. 6A and 6B are displayed on the display device 26 of the PC 12.

Third Illustrative Embodiment

Next, a printing system in accordance with a third illustrative embodiment of the present invention will be described.

The present embodiment, however, has many elements in common to those of the first embodiment, and therefore the common elements of the present embodiment will be referenced the same reference numerals or names as those of the first embodiment, without redundant description and illustration, while only the distinctive elements of the present embodiment will be described below in detail with reference to FIG. 7.

In the first embodiment, if a scheduled time of preliminary firing is reached (i.e., if it is determined that a preliminary-firing operation is needed), then a preliminary firing operation is performed non-selectively.

In contrast, in the present embodiment, a user is allowed to select one of a preliminary firing operation and a printing operation which is to be performed at a scheduled time of preliminary firing.

This selection may be achieved by a user action to the user-operable device 25 of an associated one of the PCs 12 or the user-operable device 45 of an associated one of the printers 14. The user action includes a selected one of user entry of information indicating that the user wishes to perform a preliminary firing operation at a scheduled time of preliminary firing, and user entry of information indicating that the user wishes to perform a printing operation instead of a preliminary firing operation at a scheduled time of preliminary firing. The selection is made depending on the user's wish. In either case, the entered information is stored in the non-volatile RAM 47 of the associated one of the printers 14.

Figure 7:
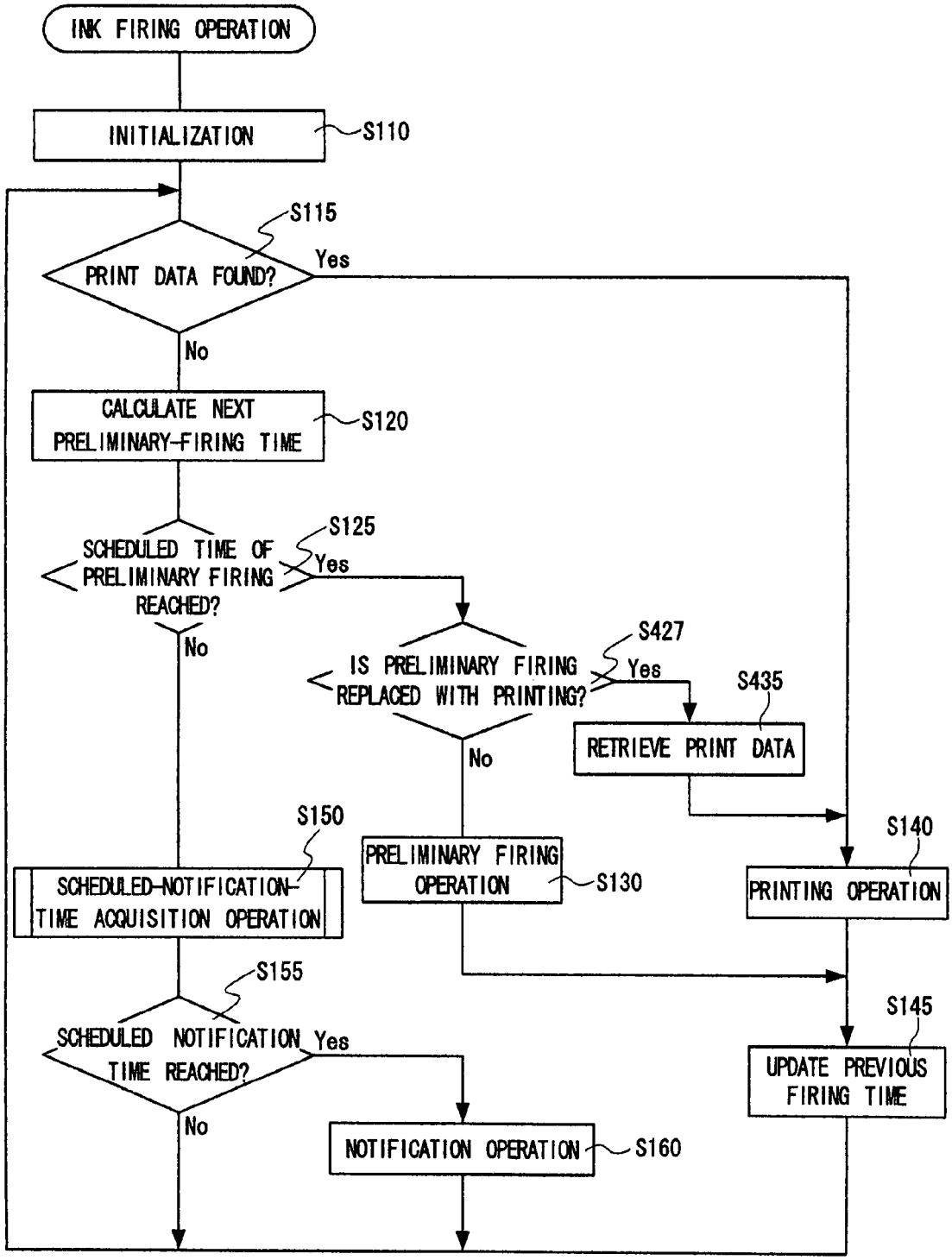
FIG. 7 is a flow chart conceptually illustrating an ink-firing operation program to be executed by a computer which is incorporated in each printer included in a printing system constructed according to a third illustrative embodiment of the invention, the ink-firing operation program being executed for performing an ink-firing operation as a main operation by each printer.

FIG. 7 conceptually illustrates in flow chart an ink-firing operation program to be executed by the CPU 41 for performing an ink firing operation in each printer 14 included in the printing system constructed in accordance with the present embodiment.

The ink firing operation in accordance with the present embodiment will be described below with reference to FIG. 7.

This ink firing operation illustrated in FIG. 7, however, includes common steps to those of the ink-firing operation program illustrated in FIG. 3, and therefore, the common steps among a plurality of steps illustrated in FIG. 7 will be referenced the same step-numbers as those in FIG. 3, without redundant description and illustration, while only the distinctive steps in FIG. 7 will be described below in detail.

Further, this ink firing operation will be described below in detail especially for the case where the user wishes to perform a printing operation instead of a preliminary firing operation at a scheduled time of preliminary firing.

Describing roughly first, when the user selects a printing operation instead of a preliminary firing operation to be performed at a scheduled time of preliminary firing, pre-set or pre-prepared print data is retrieved and a printing operation starts using the print data, at a scheduled time of preliminary firing.

During the ink firing operation illustrated in FIG. 7, if it is determined that a scheduled time of preliminary firing is reached ("Yes" branch of step S125), then a determination is made as to whether the settings stored in the non-volatile RAM 47 indicate that a preliminary firing operation is to be performed at a scheduled time of preliminary firing, or indicate that a printing operation instead of a preliminary firing operation is to be performed at a scheduled time of preliminary firing (step S427).

More specifically, at step S427, a determination is made as to whether or not the setting of the type of an operation to be performed at a scheduled time of preliminary firing (hereinafter, referred to as "operation settings") indicates a printing operation.

As described above, the user can set or enter the operation settings through preceding user-manipulation to the user-operable device 45 of the printer 14 or the user-operable device 25 of the PC 12. The user, who wishes to perform a printing operation instead of a preliminary firing operation at a scheduled time of preliminary firing, can additionally set the content and/or the kind of an image (i.e., print data) to be printed by the printing operation.

If it is determined that the operation settings indicate a preliminary firing operation ("No" branch of step S427), then the preliminary firing operation is performed in a manner as described above (step S130). Thereafter, the previous firing time is updated in a manner as described above (step S145).

If, however, it is determined that the operation settings indicate not a preliminary firing operation but a printing operation ("Yes" branch of step S427), then user-specified print data is accessed from a storage in which the print data has been stored (step S435). The storage may be located in either the RAM 23 or the RAM 43, or a device other than the PC 12 and the printers 14 (e.g., a web-site on the network 10 such as the Internet).

Thereafter, a printing operation is performed based on the print data (step S140). In an example, the print data for a current cycle of printing operation is pre-selectable as data indicative of a weather forecast report or a news articles list. As a result of this selection, the weather forecast report or the news articles list is downloaded from a certain web-server on the network 10 each time a scheduled time of preliminary firing attempts to be reached, and then printed on a print sheet P when the scheduled time of preliminary firing is reached.

It is added that a determination operation is performed at step S427 according to the settings (the content of an image to be printed) which have been stored in the non-volatile RAM 47.

The determining operation to be performed at step S427, however, is not exclusive in content. In a modified version of the present embodiment, the present invention may be practiced such that, if it is determined at step S125 that a scheduled time of preliminary firing has reached, then step S427 is implemented to display a pre-prepared set of information on the display device 26 or 46, to thereby solicit the user to specify the content of an image to be printed at the scheduled time of preliminary firing.

In a still modified version of the present embodiment, the present invention may be practiced such that, even in the presence of a user instruction indicating that a printing operation is to be performed instead of a preliminary firing operation at a scheduled time of preliminary firing, the printing operation is not performed each time the preliminary firing time is reached over time, but the printing operation is compulsorily replaced with the preliminary firing operation at intervals of a predetermined number of execution cycles.

This version allows performance-degrading factors to be removed from all the inkjet nozzles 32 with increased certainty, despite that the preliminary firing operation is not performed at every one of successive scheduled-times of preliminary firing.

As will be evident from the foregoing, in the present embodiment, the user-operable device 25 of the PC 12 and the user-operable device 45 and the non-volatile RAM 47 both of each printer 14, and a portion of the CPU 41, the ROM 42 and the RAM 43 of each printer 14 which is assigned to execute step S427 illustrated in FIG. 7, illustratively, together constitute an example of the "manual selector" set forth in the above-described ninth mode of the invention.

Further, in the present embodiment, a portion of the CPU 41, the ROM 42 and the RAM 43 of each printer 14 which is assigned to execute step S435 illustrated in FIG. 7, illustratively, constitutes an example of the "special-print-command issuer" set forth in the above-described eleventh mode of the invention.

Fourth Illustrative Embodiment

Next, a printing system in accordance with a fourth illustrative embodiment of the present invention will be described.

The present embodiment, however, has many elements in common to those of the first embodiment, and therefore the common elements of the present embodiment will be referenced the same reference numerals or names as those of the first embodiment, without redundant description and illustration, while only the distinctive elements of the present embodiment will be described below in detail with reference to FIG. 8.

In the first embodiment, application programs various in content are executed in the respective printers 14 for providing to a user an advance notice of next preliminary firing.

In contrast, in the printing system constructed according to the present embodiment, an application program has been installed in the PC 12 for performing a recommended-printer display operation by globally monitoring the plurality of printers 14 coupled to the network 10.

The monitoring, however, may be performed only for a part of the printers 14 all coupled to the network 10. In an example, only one or more inkjet printers are monitored, and, if a predetermined condition is met, at least one of them is each selected as a target printing device. In another example, only one or more inkjet printers which are highly likely to be kept being switched on at all times, such as all-in-one apparatuses having a facsimile function, and, if a predetermined condition is met, at least one of them is each selected as a target printing device.

In a further embodiment, the plurality of printers 14 are monitored in terms of a scheduled time of preliminary firing. In this embodiment, although such a message as illustrated in FIG. 6B may be displayed to the user for all of at least one of the plurality of printers 14 which has scheduled notification time that has been reached, the message may be displayed to the user for only one of the plurality of printers 14 which has the earliest one of scheduled times of preliminary firing calculated for the plurality of printers 14, respectively.

Figure 8:
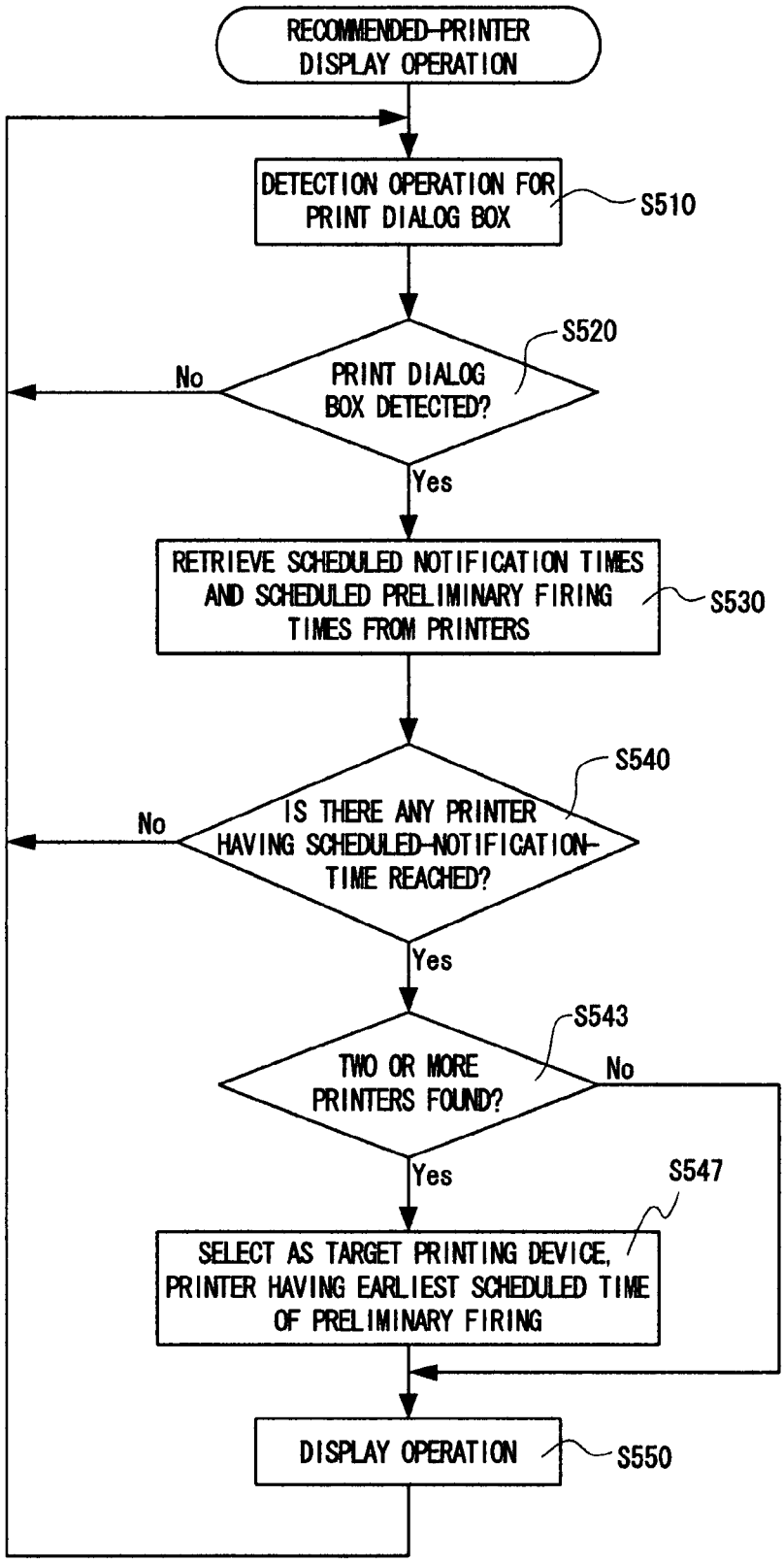
FIG. 8 is a flow chart conceptually illustrating a recommended-printer display-operation program to be executed by a computer unit of a PC (Personal Computer) included in a printing system constructed according to a fourth illustrative embodiment of the invention, the recommended-printer display-operation program being executed for performing a recommended-printer display operation by the PC.

FIG. 8 conceptually illustrates in flow chart a recommended-printer display-operation program to be executed by the CPU 21 for performing the recommended-printer display operation according to the present embodiment.

During this recommended-printer display operation, the detection operation for print dialog box is first performed for each of all the printers 14, in a manner similar with step S310 depicted in FIG. 5 (step S510).

Next, a determination is made as to whether or not a print dialog box has been detected for each of all the printers 14, in a manner similar with step S320 depicted in FIG. 5 (step S520). If it is determined that no print dialog box has been detected for each of all the printers 14 ("No" branch of step S520), then this operation returns to step S510.

If, however, it is determined that a print dialog box has been detected for at least one of the printers 14 ("Yes" branch of step S520), then a scheduled notification time is captured from each of at least one printer 14 for which a print dialog box has been detected (hereinafter, each referred to as "prospective printer 14"), in a manner similar with step S330 depicted in FIG. 5 (step S530). Additionally, the PC 12 captures time information concerning the preliminary firing time, from each of the at least one prospective printer 14 (step S530).

Thereafter, a determination is made as to whether or not a current time has reached the captured scheduled-notification-time, for each of the at least one prospective printer 14 (step S540). If it is determined that the current time has not reached the scheduled notification time for all the at least one prospective printer 14 ("No" branch of step S540), then this operation returns to step S510 immediately to perform the detection operation for a print dialog box again.

If, however, it is determined that a current time has reached the scheduled notification time for at least one prospective printer 14 (hereinafter, each referred to as "candidate printer 14") ("Yes" branch of step S540), then a determination is made as to whether or not there are two or more candidate printers 14 (step S543).

If there is only one candidate printer 14 ("No" branch of step S543), then this operation progresses to step S550 immediately to display the message dialog box depicted in FIG. 6B for the candidate printer 14.

If, however, it is determined that there are two or more candidate printers 14 (i.e., ones of all the printers 14 which have been determined to have the scheduled notification times that have been reached) ("Yes" branch of step S543), then a comparison is made between a scheduled time of preliminary firing and a current time, for each of the two or more candidate printers 14 (step S547).

Further, at step S547, one of the two or more candidate printers 14 is selected as a target printing device, which has the closest scheduled-time of preliminary firing to the current time among those of the two or more candidate printers 14.

Thereafter, a message is displayed to the user to the effect that preliminary firing will start soon, such as illustrated in FIG. 6B, for one of the printers 14 which has been selected as the target printing device (step S550).

Thus, one of the printers 14 which has the preliminary firing time that will be reached first is preferentially selected as a target printing device.

This allows the total number or the total frequency of preliminary firing operations that will be performed for all the printers 14 attached to the network 10, to be reduced relative to those obtained in a comparative example where the user is prompted to instruct a printing operation equally for all ones of the printers 14 each of which has scheduled-notification-time that has been reached.

As will be evident from the foregoing, in the present embodiment, each PC 12, illustratively, constitutes an example of the "terminal equipment" set forth in the above-described fifteenth mode of the invention, and a portion of each PC 12 which is assigned to execute steps S510-S540, S543 and S547 in illustrated in FIG. 8, illustratively, constitutes an example of the "recording-device selector" set forth in the same mode and an example of the "frequency reducer" set forth in the above-described first mode of the invention.

Fifth Illustrative Embodiment

Next, a printing system in accordance with a fifth illustrative embodiment of the present invention will be described.

The present embodiment, however, is different from the first embodiment only with respect to elements concerning the ink firing operation, and is common to the first embodiment with respect to other elements. The common elements of the present embodiment, therefore, will be referenced the same reference numerals or names as those of the first embodiment, without redundant description and illustration, while only the different elements of the present embodiment will be described below in detail with reference to FIG. 10.

In the first embodiment, upon termination of a printing operation at step S140 depicted in FIG. 3, the previous firing time "tn" is inevitably updated at step S145. For this reason, in the first embodiment, upon termination of a printing operation after the advance notice of preliminary firing, a scheduled preliminary-firing operation is eliminated, irrespective of whether or not the printing operation successfully caused all the inkjet nozzles 32 to fire ink droplets in adequate amounts.

In contrast, in the present embodiment, a total number of cycles of ink firing performed during one or more preceding printing operations is counted on a per-inkjet-nozzle basis, for all the inkjet nozzles 32, and the counted total number (hereinafter, referred to as "expelled-drop count") is stored in the RAM 43.

Further, if a scheduled time of preliminary firing (i.e., the aforementioned "next preliminary firing time") "tn+1" is reached, then a determination is made as to whether or not the smallest one of the expelled-drop counts (hereinafter, referred to as "smallest expelled-drop count") which have been measured for the inkjet nozzles 32, respectively, exceeds a set value, that is to say, whether or not the smallest one of the total amounts of ink droplets ejected which have been measured for the inkjet nozzles 32 (hereinafter, referred to as "smallest amount-of-ink-expelled"), respectively, is adequately large.

If the smallest expelled-drop count does not exceed the set value, then preliminary firing is performed. Only if the smallest expelled-drop count exceeds the set value, preliminary firing is eliminated.

Figure 10:
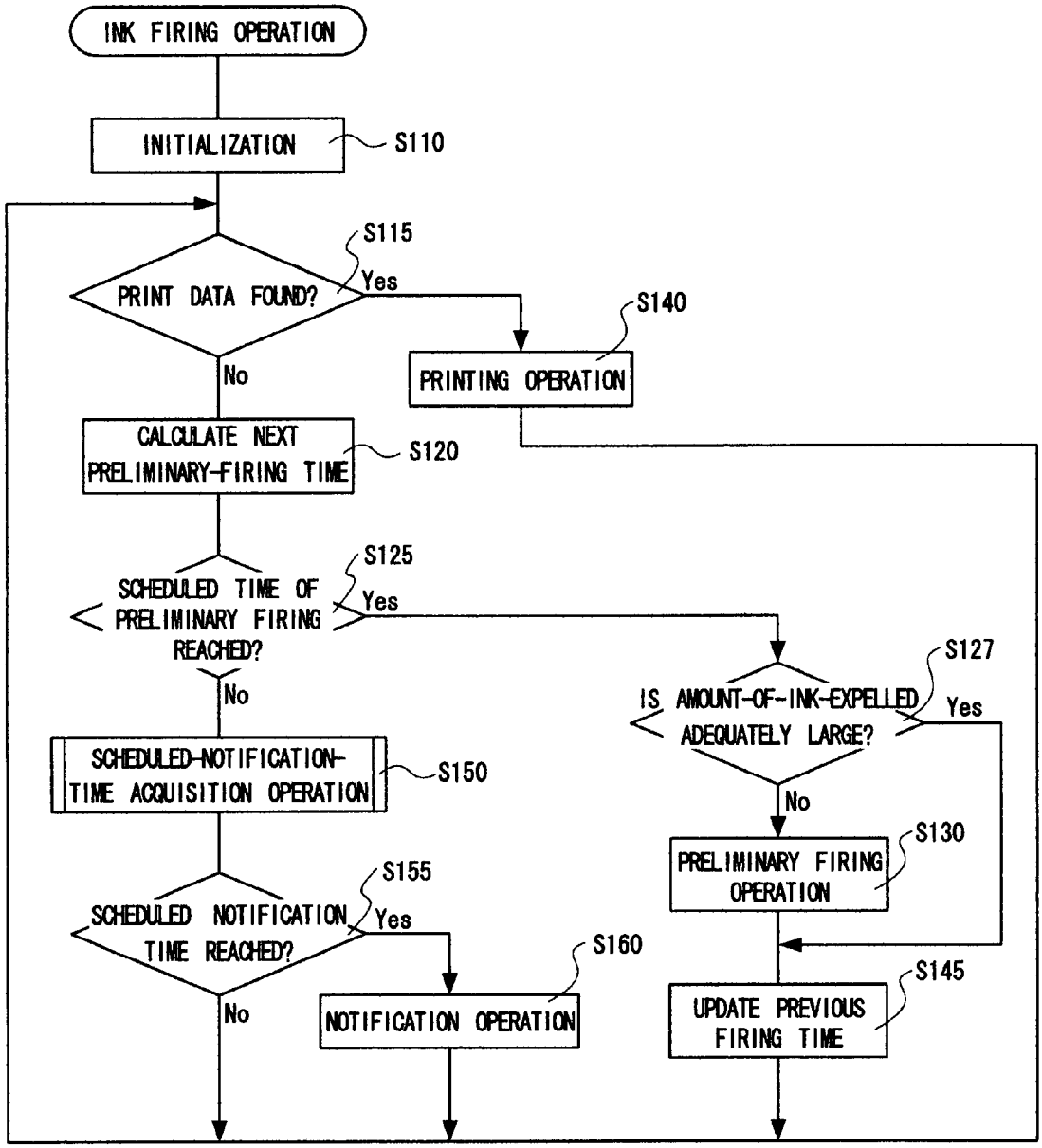
FIG. 10 is a flow chart conceptually illustrating an ink-firing operation program to be executed by a computer which is incorporated in each printer included in a printing system constructed according to a fifth illustrative embodiment of the invention, the ink-firing operation program being executed for performing an ink-firing operation as a main operation by each printer.

FIG. 10 conceptually illustrates in flow chart an ink-firing operation program to be executed in each printer 14 included in the printing system according to the present embodiment, for performing an ink firing operation.

Although this ink-firing operation program will be described below with reference to FIG. 10, this program includes common steps to those of the ink-firing operation program illustrated in FIG. 3. The common steps among a plurality of steps illustrated in FIG. 10, therefore, will be referenced the same step-numbers as those in FIG. 3, without redundant description and illustration, while only the distinctive steps in FIG. 10 will be described below in detail.

During the ink firing operation, upon termination of a certain cycle of the printing operation (i.e., one print-cycle) (step S140), this ink firing operation returns to step S115 without implementing step S145.

If a scheduled time of preliminary firing "tn+1" is reached ("Yes" branch of step S125), then a determination is made as to whether or not the above-described smallest expelled-drop count exceeds the set value, that is to say, whether or not the above-described smallest amount-of-ink-expelled is adequately large (step S127).

If the smallest expelled-drop count does not exceed the set value ("No" branch of step S127), then preliminary firing is performed (step S130). Thereafter, the previous firing time "tn" is updated so as to be equal to a current time "t0" (step S145).

If, however, the smallest expelled-drop count exceeds the set value ("Yes" branch of step S127), then the previous firing time "tn" is updated so as to be equal to a current time "t0" (step S145), without experiencing preliminary firing.

Thus, preliminary firing is eliminated only when the smallest expelled-drop count exceeds the set value, which prevents print quality from being degraded due to excessive bias toward saving of the amount of ink to be spent during preliminary firing.

As will be evident from the foregoing, in the present embodiment, a portion of the CPU 41, the ROM 42 and the RAM 43 of each printer 14 which is assigned to execute step S127 illustrated in FIG. 10, illustratively, constitutes an example of the "nozzle-cleaning inhibitor" set forth in the above-described tenth mode of the invention, and an event that the smallest expelled-drop count exceeds the set value, illustratively, constitutes an example of the "predetermined condition" set forth in the same mode.

Sixth Illustrative Embodiment

Next, a printing system in accordance with a sixth illustrative embodiment of the present invention will be described.

The present embodiment, however, is different from the fifth embodiment only with respect to elements concerning the ink firing operation, and is common to the fifth embodiment with respect to other elements. The common elements of the present embodiment, therefore, will be referenced the same reference numerals or names as those of the fifth embodiment, without redundant description and illustration, while only the different elements of the present embodiment will be described below in detail with reference to FIG. 11.

The present embodiment is common to the fifth embodiment in that preliminary firing is eliminated only when the smallest amount-of-ink-expelled is a dequately large. The present embodiment, however, is different from the fifth embodiment, because the present embodiment provides a user-selection function of allowing a user to select one of a preliminary firing operation and a printing operation to be performed at a scheduled time of preliminary firing, while the fifth embodiment does not provide such a user-selection function.

The present embodiment is common to the third embodiment, because the third embodiment provides such a user-selection function.

The present embodiment, however, is different from the third embodiment, because the present embodiment provides a function of automatically printing a plurality of predetermined or pre-prepared pictures in succession, at a scheduled time of preliminary firing, and of terminating the automatic printing at a time instant that the smallest amount-of-ink-expelled becomes adequately large, while the third embodiment does not provide such a function.

Figure 11:
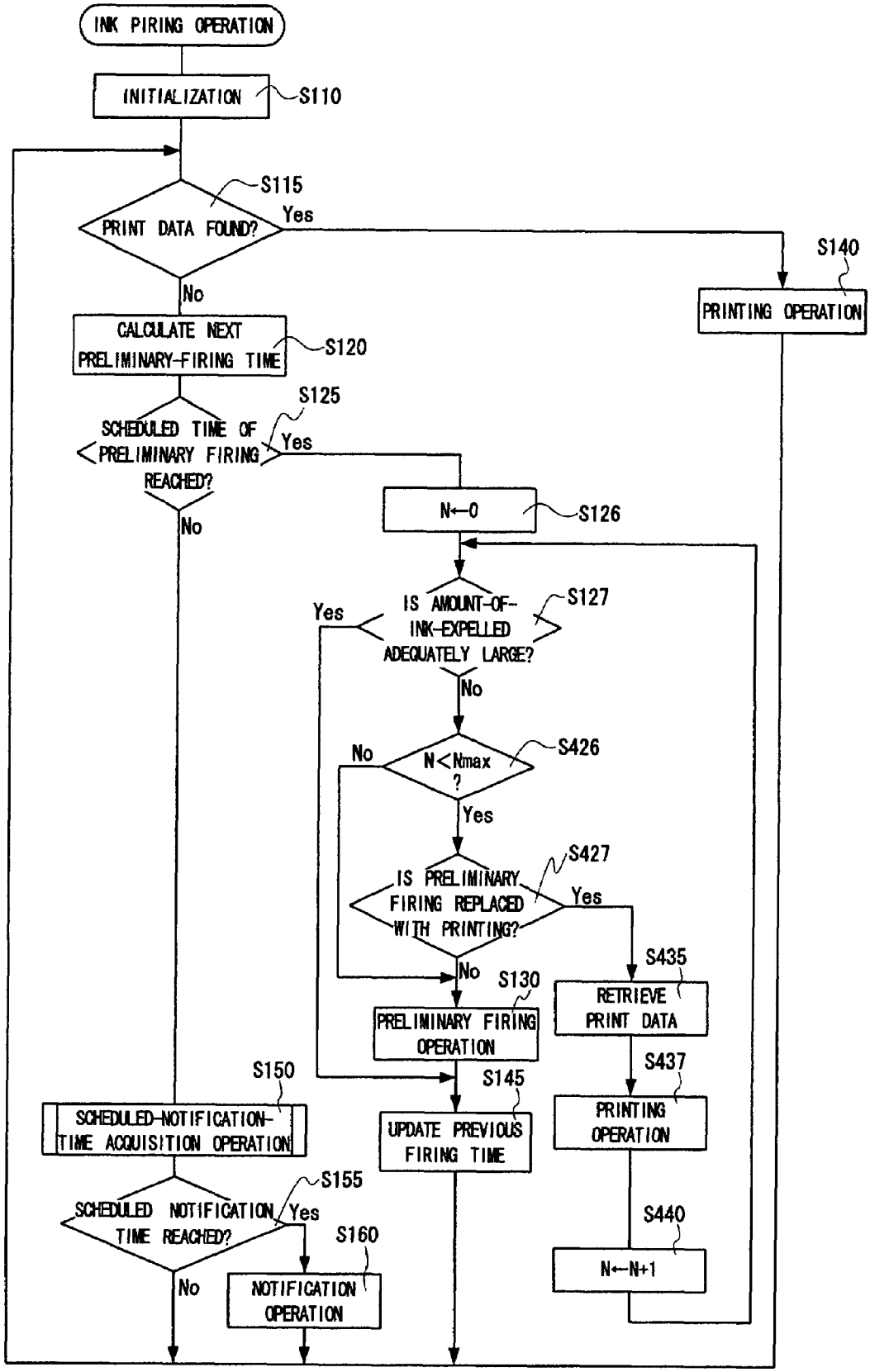
FIG. 11 is a flow chart conceptually illustrating an ink-firing operation program to be executed by a computer which is incorporated in each printer included in a printing system constructed according to a sixth illustrative embodiment of the invention, the ink-firing operation program being executed for performing an ink-firing operation as a main operation by each printer.

FIG. 11 conceptually illustrates in flow chart an ink-firing operation program to be executed in each printer 14 included in the printing system according to the present embodiment, to perform an ink firing operation.

Although this ink-firing operation program will be described below with reference to FIG. 11, this program includes common steps to those of the ink-firing operation programs illustrated in FIGS. 3 and 10. The common steps among a plurality of steps illustrated in FIG. 11, therefore, will be referenced the same step-numbers as those in FIGS. 3 and 10, without redundant description and illustration, while only the distinctive steps in FIG. 11 will be described below in detail.

During the ink firing operation, if a scheduled time of preliminary firing (i.e., the aforementioned "next preliminary firing time") "tn+1" is reached ("Yes" branch of step S125), then a value of an attempt count N, which will be described below in greater detail, is set to zero (step S126). Thereafter, a determination is made as to whether or not the smallest amount-of-ink-expelled is adequately large (step S127).

If the smallest amount-of-ink-expelled is adequately large ("Yes" branch of step S127), then the previous firing time "tn" is updated so as to be equal to a current time "t0" without experiencing a preliminary firing operation (step S145).

If, however, the smallest amount-of-ink-expelled is not adequately large ("No" branch of step S127), then a determination is made as to whether or not a current value of the attempt count N is smaller than a maximum value Nmax (step S426).

If the current value of the attempt count N is smaller than the maximum value Nmax ("Yes" branch of step S426), then a determination is made as to whether or not the operation settings for specifying the type of an operation to be performed at a scheduled time of preliminary firing indicates a printing operation (step S427).

If the operation settings indicate a printing operation ("Yes" branch of step S427), then user-specified print data is accessed from a storage in which the print data has been stored (step S435).

In the present embodiment, a plurality of various sets of print data corresponding to a plurality of respective pictures are accessed from the storage in succession. Further, one of the sets of print data which has been assigned a serial No. 1 (i.e., a first set of print data) is defined as a current set of print data.

Thereafter, a first picture is printed on a print sheet P, based on the first set of print data (step S437). In the present embodiment, step S437 attempts to be repeated for preventing a later-printed image from being degraded due to elimination of an preliminary firing operation at a scheduled time of preliminary firing "tn+1."

The repetition number of implementation of step S437 is defined as the aforementioned attempt count N, the value of which indicates how many pictures are automatically printed at a scheduled time of preliminary firing "tn+1."

Thereafter, the attempt count N is incremented by one (step S440), and this operation returns to step S127.

If printing of the first picture has made the smallest amount-of-ink-expelled to be adequately large ("Yes" branch of step S127), then step S130 is skipped and step S145 is implemented.

If, however, printing of the first picture has not yet made the smallest amount-of-ink-expelled to be adequately large ("No" branch of step S127), then a determination is made as to whether or not the current value of the attempt count N is smaller than the maximum value Nmax (step S426).

If the current value of the attempt count N is smaller than the maximum value Nmax ("Yes" branch of step S426), then a determination is made as to whether or not the operation settings for specifying the type of an operation to be performed at a scheduled time of preliminary firing indicate a printing operation (step S427).

Because it has been assumed that the operation settings indicate a printing operation to be performed ("Yes" branch of step S427), a second set of print data is subsequently obtained (step S435).

The second set of print data is not completely equal to the first set of print data, in terms of positions of ones of the inkjet nozzles 32 to be selectively used for printing. This leads to a probabilistic conclusion that the smallest amount-of-ink-expelled is more likely to become adequately large when a plurality of pictures are printed than when only one picture is printed.

Thereafter, a second picture is printed on a separate print sheet P, based on the second set of print data (step S437). Subsequently, the attempt count N is incremented by one (step S440), and this operation returns to step S127.

If printing of the second picture has made the smallest amount-of-ink-expelled to be adequately large ("Yes" branch of step S127), then step S130 is skipped and step S145 is implemented. If, however, printing of the second picture has not yet made the smallest amount-of-ink-expelled to be adequately large ("No" branch of step S127), then a determination is made as to whether or not the current value of the attempt count N is smaller than the maximum value Nmax (step S426).

If repeated implementation of a loop comprised of steps S127, S426, S427, S435, S437 and S440 has made the current value of the attempt count N to be equal to or larger than the maximum value Nmax ("No" branch of step S426), then a preliminary firing operation is performed, even where the operation settings for specifying the type of an operation to be performed at a scheduled time of preliminary firing indicate a printing operation (step S130).

Thus, in the present embodiment, a preliminary firing operation is performed, even where a user has instructed that a printing operation is to be performed instead of a preliminary firing operation at a scheduled time of preliminary firing, if elimination of the preliminary firing operation faithful to the user instruction would possibly result in degraded quality of a later-printed image.

The present embodiment, therefore, can attempt to reduce an amount of ink to be spent during preliminary firing, while preferentially maintaining print quality.

As will be evident from the foregoing, in the present embodiment, a portion of the CPU 41, the ROM 42 and the RAM 43 of each printer 14 which is assigned to execute steps S427, S435 and S437 illustrated in FIG. 11, illustratively, constitutes an example of the "special-print-command-issuer" set forth in the above-described eleventh mode of the invention, a portion of the CPU 41, the ROM 42 and the RAM 43 of each printer 14 which is assigned to execute steps S126, S435 and S440 illustrated in FIG. 11, illustratively, constitutes an example of the "sequential issuer" set forth in the above-described twelfth mode of the invention, and a portion of the CPU 41, the ROM 42 and the RAM 43 of each printer 14 which is assigned to execute steps S126, S426 and S440 illustrated in FIG. 11, illustratively, constitutes an example of the "shifter" set forth in the above-described thirteenth mode of the invention.

It is noted that, in an alternative embodiment, the present invention may be practiced such that a user is allowed to select one of an ink save mode and a high quality mode, through user manipulation.

The ink save mode is to be selected by the user who prefers saving of an amount of ink to be spent to the maintenance of print quality. In the ink save mode, once the user issues, prior to a scheduled time of preliminary firing, a print command for preventing next preliminary firing, preliminary firing is eliminated irrespective of whether or not the aforementioned smallest amount-of-ink-expelled is large (whether or not the possibility of causing poor print quality due to elimination of preliminary firing is high).

On the other hand, the high quality mode is to be selected by the user who wishes to save an amount of ink to be spent if possible, but who prefers maintenance of print quality to the saving of an amount of ink to be spent. In the high quality mode, once the user issues, prior to a scheduled time of preliminary firing, a print command for preventing next preliminary firing, preliminary firing is eliminated, provided that the aforementioned smallest amount-of-ink-expelled exceeds the set value.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An inkjet recording device comprising:

a printhead having a plurality of inkjet nozzles for firing ink droplets therethrough;

a printing controller arranged to operate, upon reception of a print command, to selectively activate the plurality of inkjet nozzles to fire ink droplets, thereby performing a printing operation for printing an image on a recording medium;

a nozzle-cleaning controller arranged to activate the plurality of inkjet nozzles to fire ink droplets, thereby performing a nozzle cleaning operation for removing performance-degrading factors from the plurality of inkjet nozzles;

a calculator arranged to calculate a scheduled time of a next nozzle-cleaning operation which succeeds a time instant at which a last firing operation was implemented by the printhead, by a predetermined reference-time-interval;

a nozzle-cleaning activator arranged to activate the nozzle-cleaning controller if a current time reaches the calculated scheduled-time of nozzle-cleaning operation; and a frequency reducer arranged to perform an operation concerning a reduction in a frequency at which the nozzle-cleaning operation is repeated by the printhead, by monitoring the calculated scheduled-time of a next nozzle-cleaning operation, on a time-line basis.

2. The inkjet recording device according to claim 1, wherein the frequency reducer includes a prompter arranged to prompt a user to enter the print command into the printing controller, prior to the calculated scheduled-time of nozzle-cleaning operation.

3. The inkjet recording device according to claim 1, wherein the frequency reducer includes a presentation device arranged to present to a user, time information pertaining to the calculated scheduled-time of nozzle-cleaning operation, prior to the calculated scheduled-time of nozzle-cleaning operation.

4. The inkjet recording device according to claim 1, wherein the frequency reducer includes:

a calculating section arranged to calculate a scheduled time of notification which precedes the calculated scheduled-time of nozzle-cleaning operation by a predetermined time period; and a notifier arranged to provide a user with a notification indicating that the printhead is scheduled to initiate the next nozzle-cleaning operation soon, through activation of a visible, audible or tactual alarm, if a current time reaches the calculated scheduled-time of notification.

5. The inkjet recording device according to claim 1, wherein the calculator includes:

a storage in which data indicative of the time instant of the last firing operation is to be stored; and a calculating section arranged to calculate the scheduled time of the next nozzle-cleaning operation, by adding the predetermined reference-time-interval to the time instant of the last firing operation indicated by the data which has been stored in the storage.

6. The inkjet recording device according to claim 4, wherein the notifier includes:

a calculating section arranged to calculate the scheduled time of notification, by subtracting the predetermined time period from the calculated scheduled-time of nozzle-cleaning operation;

a comparator arranged to compare the calculated scheduled-time of notification and a current time with each other; and an alarm activator arranged to activate the alarm if a status of the comparator indicates that the current time has reached the scheduled time of notification.

7. The inkjet recording device according to claim 4, further comprising:

a pre-setter arranged to pre-set an inhibition time range for notification during which the notifier is to be inhibited from notifying the user; and a notification inhibitor arranged to inhibit the notifier from notifying the user, when the calculated scheduled-time of notification is within the pre-set inhibition time range for notification.

8. The inkjet recording device according to claim 4, further comprising:

a pre-setter arranged to pre-set an inhibition time range for notification during which the notifier is to be inhibited from notifying the user; and a changer arranged to operate, when the calculated scheduled-time of notification is within the pre-set inhibition time range for notification, to change the calculated scheduled-time of notification to a time instant preceding a start time of the pre-set inhibition time range for notification.

9. The inkjet recording device according to claim 1, further comprising a manual selector arranged to operate responsive to a user-issued select command to select one of the printing operation and the nozzle cleaning operation as an operation to be performed by the printhead at the calculated scheduled-time of nozzle-cleaning operation.

10. The inkjet recording device according to claim 1, wherein the frequency reducer includes a nozzle-cleaning inhibitor arranged to inhibit the nozzle cleaning operation from being performed at the calculated scheduled-time of nozzle-cleaning operation, provided that a predetermined condition is met which relates to amounts of ink droplets ejected from the respective inkjet nozzles before the calculated scheduled-time of nozzle-cleaning operation is reached.

11. The inkjet recording device according to claim 1, wherein the frequency reducer includes a special-print-command issuer arranged to issue, at the calculated scheduled-time of nozzle-cleaning operation, a special print command to the printing controller for printing at least one predetermined picture on the recording medium based on a predetermined print data.

12. The inkjet recording device according to claim 11, wherein the at least one predetermined picture includes a plurality of pictures having contents not identical to each other with respect to positions of selectively-activated ones of the plurality of inkjet nozzles for printing the respective corresponding pictures, and the special-print-command issuer includes a sequential issuer arranged to be activated at the calculated scheduled-time of nozzle-cleaning operation and sequentially issue a plurality of special print commands to the printing controller, for sequentially printing the plurality of pictures, before a predetermined condition is met which relates to amounts of ink droplets actually ejected from the respective inkjet nozzles.

13. The inkjet recording device according to claim 12, wherein the frequency reducer further includes a shifter arranged to activate the nozzle cleaning controller instead of the printing controller, if the condition has failed to be met despite that the special print commands have been provided to the printing controller in succession, with a total number of the issued special-print-commands exceeding an upper limit, at the calculated scheduled-time of nozzle-cleaning operation.

14. A network-attached recording system having a plurality of recording devices and a common terminal equipment which is communicatable with the plurality of recording devices via a network, and capable of selectively using the plurality of recording devices thereby printing an image on a recording medium, in response to entry of a print command through the terminal equipment, wherein the plurality of recording devices include at least one inkjet recording device, each of the at least one inkjet recording device comprises:

a printhead having a plurality of inkjet nozzles for firing ink droplets therethrough;

a printing controller arranged to operate, upon reception of the print command, to selectively activate the plurality of inkjet nozzles to fire ink droplets, thereby performing a printing operation for printing an image on a recording medium;

a nozzle-cleaning controller arranged to activate the plurality of inkjet nozzles to fire ink droplets, thereby performing a nozzle cleaning operation for removing performance-degrading factors from the plurality of inkjet nozzles;

a nozzle-cleaning-time calculator arranged to calculate a scheduled time of a next nozzle-cleaning operation which succeeds a time instant at which a last firing operation was implemented by the printhead, by a predetermined reference-time-interval;

a nozzle-cleaning activator arranged to activate the nozzle-cleaning controller if a current time reaches the calculated scheduled-time of nozzle-cleaning operation; and a reference-time-instant calculator arranged to calculate a reference time instant for the at least one inkjet recording device, as a time instant preceding the calculated scheduled-time of nozzle-cleaning operation by a predetermined time period, on a per-inkjet-recording-device basis, and the terminal equipment comprises a selector arranged to perform an operation concerning selection of one of the at least one inkjet recording device which has a calculated reference-time-instant that has been reached, as a target recording-device to be activated in response to entry of the print command through the terminal equipment.

15. A network-attached recording system having a plurality of recording devices and a common terminal equipment which is communicatable with the plurality of recording devices via a network, and capable of selectively using the plurality of recording devices thereby printing an image on a recording medium, in response to entry of a print command through the terminal equipment, wherein the plurality of recording devices include a plurality of inkjet recording devices, each of the plurality of inkjet recording devices comprises:

a printhead having a plurality of inkjet nozzles for firing ink droplets therethrough;

a printing controller arranged to operate, upon reception of the print command, to selectively activate the plurality of inkjet nozzles to fire ink droplets, thereby performing a printing operation for printing an image on a recording medium;

a nozzle-cleaning controller arranged to activate the plurality of inkjet nozzles to fire ink droplets, thereby performing a nozzle cleaning operation for removing performance-degrading factors from the plurality of inkjet nozzles;

a nozzle-cleaning-time calculator arranged to calculate a scheduled time of a next nozzle-cleaning operation which succeeds a time instant at which a last firing operation was implemented by the printhead, by a predetermined reference-time-interval; and a nozzle-cleaning activator arranged to activate the nozzle-cleaning controller if a current time reaches the calculated scheduled-time of nozzle-cleaning operation, and the terminal equipment comprises a recording-device selector arranged to perform an operation concerning selection of one of the plurality of inkjet recording devices which has an earliest one of scheduled-times of nozzle-cleaning operations calculated for the plurality of inkjet recording devices, respectively, as a target recording-device to be activated in response to entry of the print command through the terminal equipment.

16. A method of controlling an inkjet recording device having a printhead having a plurality of inkjet nozzles for firing ink droplets therethrough, the method comprising;

a printing step, upon reception of a print command, of selectively activating the plurality of inkjet nozzles to fire ink droplets, thereby performing a printing operation for printing an image on a recording medium;

a nozzle-cleaning step of activating the plurality of inkjet nozzles to fire ink droplets, thereby performing a nozzle cleaning operation for removing performance-degrading factors from the plurality of inkjet nozzles;

a step of calculating a scheduled time of a next nozzle-cleaning operation which succeeds a time instant at which a last firing operation was implemented by the printhead, by a predetermined reference-time-interval;

a step of implementing the nozzle-cleaning step if a current time reaches the calculated scheduled-time of nozzle-cleaning operation; and a frequency reduction step of performing an operation concerning a reduction in a frequency at which the nozzle-cleaning operation is repeated by the printhead, by monitoring the calculated scheduled-time of nozzle-cleaning operation, on a time-line basis.

17. The method according to claim 16, wherein the inkjet recording device is used with at least one separate recording device for printing an image in a non-inkjet manner, whereby the inkjet recording device and the at least one separate recording device together constitute a plurality of recording devices, the plurality of recording devices are communicable with a common terminal equipment via a network, the plurality of recording devices are selectively used for printing an image on a recording medium, in response to entry of a print command through the terminal equipment, the frequency reduction step comprises:

a sub-step of calculating a reference time instant for the inkjet recording device, as a time instant preceding the calculated scheduled-time of nozzle-cleaning operation by a predetermined time period; and a sub-step of performing an operation concerning selection of the inkjet recording device as a target recording-device to be activated in response to entry of the print command through the terminal equipment, if a current time reaches the reference time instant for the inkjet recording device.

* * * * *